US006198491B1

(12) United States Patent
Honda

(10) Patent No.: US 6,198,491 B1
(45) Date of Patent: Mar. 6, 2001

(54) ELECTROPHOTOGRAPHIC IMAGE FORMING APPARATUS

(75) Inventor: Takao Honda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/452,183

(22) Filed: Dec. 2, 1999

(30) Foreign Application Priority Data

Dec. 3, 1998 (JP) ..... 10-344115
Dec. 15, 1998 (JP) ..... 10-356632

(51) Int. Cl.[7] ..... B41J 2/385; G03G 13/04; G03G 15/00

(52) U.S. Cl. ..... 347/129; 347/140; 399/44

(58) Field of Search ..... 347/129, 140, 347/153; 399/94, 69, 97, 44

(56) References Cited

U.S. PATENT DOCUMENTS

| | | | | |
|---|---|---|---|---|
| 2,221,776 | | 11/1940 | Carlson | 430/48 |
| 2,297,961 | | 10/1942 | Hughes | 101/96 |
| 2,874,063 | | 2/1959 | Greig | 430/106.6 |
| 4,676,627 | * | 6/1987 | Ohno | 399/44 |
| 4,982,225 | * | 1/1991 | Sakakibara et al. | 399/44 X |
| 5,148,218 | * | 9/1992 | Nakane et al. | 399/44 X |
| 5,805,954 | * | 9/1998 | Takahashi | 399/44 |
| 5,887,223 | * | 3/1999 | Sakai et al. | 399/444 X |

FOREIGN PATENT DOCUMENTS 17-23910 11/1942 (JP) .
18-24748 10/1943 (JP) .

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus for effecting an image exposure on an electrophotographic photosensitive member by a digital optical system device, having a charging device for charging the photosensitive member, an electrostatic latent image forming device for forming a minute dot pattern corresponding to image data, a developing device for developing the latent image on the photosensitive member with a developer, a transfer device for transferring the developer image onto a transfer material, a fixing device for fixing the developed image on the transfer material, a photosensitive member surface cleaning device for cleaning residual developer remaining on the photosensitive member after transferring, a detector for detecting the fixing device's temperature, and a detector for detecting a water vapor amount in a surrounding environment, and wherein, when a power supply of the apparatus is powered ON and if a fact that the detected temperature of the fixing device is a predetermined temperature or lower and a fact that the detected water vapor amount in the surrounding environment is a predetermined water vapor amount or larger, the charging device, optical system device for forming the minute dot pattern or minute line pattern, the developing device and the photosensitive member surface cleaning devices are operated to abrade the photosensitive member under a state that a preparation of a starting operation of the electrostatic latent image forming device for image formation is not completed.

32 Claims, 20 Drawing Sheets

ELECTROPHOTOGRAPHIC IMAGE FORMING APPARATUS

BACKGROUND OF THE INVENTION

1. Field of the Invention

The present invention relates to an image forming apparatus using an electrophotographic process.

2. Related Background Art

Recently, image forming apparatuses used as a hardware output machines for digital data information transmission via a data communication network and such information has been proposed like anything. As such image forming apparatuses, digital printers and digital copying machines are known.

Now, as an example of a conventional image forming apparatus, a digital printer will be schematically described with reference to FIG. 19.

FIG. 19 is a constructural view showing main portions of the digital printer. In FIG. 19, a photosensitive drum 1 as an electrophotographic photosensitive member is constituted by coating a photoconductive layer on a cylindrical conductive substrate and is supported for rotation in a direction shown by the arrow R1. Around the photosensitive drum 1, there are disposed, in order along a rotational direction thereof, a scorotron charger 2 for uniformly charging a surface of the photosensitive drum 1, an exposure device for reading an original and for forming an electrostatic latent image by exposure the photosensitive drum 1 in accordance with an image signal proportional to image density, a developing device 4 for forming a toner image by adhering toner to the electrostatic latent image, a corona transfer charger (transfer charger) 8 for transferring the toner image formed on the photosensitive drum 1 onto a transfer sheet (transfer material) P, an electrostatic separating charger (separating charger) 9 for separating the transfer sheet P to which the toner image is transferred from the photosensitive drum 1, a cleaning device 13 for removing residual toner from the photosensitive drum 1 after the toner image is transferred, and a pre-exposure (lamp) 30 for eliminating residual charge on the photosensitive drum 1.

By the way, after separated from the photosensitive drum 1 the transfer sheet P to which the toner image is transferred is conveyed to a fixing device 12, where the toner image is fixed to the transfer sheet to obtain a desired print image, and the transfer sheet P to which the toner image is fixed is discharged out of a main body of the image forming apparatus.

On the other hand, in a reader portion 18, an original 15 rested on an original glass stand 14 is illuminated by an illumination lamp 16, and light reflected from the original 15 is imaged on a photo-electric converting element (one-line CCD) 19 to convert the light into an electrical signal corresponding to image information. The light reflected from the original 15 illuminated by the illumination lamp 16 is imaged on the photo-electric converting element 19 through mirrors 17*a*, 17*b*, 17*c* and a lens 17*d*. The electrical signal outputted from the photo-electric converting element 19 is A/D-converted by an A/D-converter 21 into an 8-bit digital image data which is in turn logarithmically transformed in a black signal generating circuit 22 for changing luminance information to density information to obtain image density data.

The 8-bit digital image data signal formed in this way is inputted to a laser driving circuit 24. The laser driving circuit 24 is a well-known PWM circuit which modulates a light emitting time for ON/OFF of a laser diode in accordance with magnitude of the image density signal inputted.

For example, when the image data per pixel is inputted in a laser scanning direction as shown in FIG. 4A, a driving signal for ON/OFF of the laser becomes as shown in FIG. 4B. That is to say, ON duty of the laser driving signal when the image data is 00 hex is selected to 5% of one pixel scanning time, and ON duty of the laser driving signal when the image data is FF hex is selected to 85% of one pixel scanning time. A tone (dark/light) is achieved by effecting area-gradation within one pixel in this way.

Further, FIG. 6 shows general I–L property (driving electric current–amount of light property) of the laser. Since driving currents used for ON and OFF of the laser are $I_{on}$ and $I_{off}$, respectively, the laser driving signal for the image signal of FIG. 4A becomes as shown in FIG. 4C, which is current for driving the laser by the PWM circuit.

By the way, the laser driving circuits are generally divided into the above-mentioned PWM circuit and a binary value laser driving circuit. As mentioned above, the PWM circuit serves to modulate to a pulse width signal corresponding to the time for lighting the laser diode in accordance with the magnitude of the inputted image density signal; whereas, in the binarizing circuit, the signal is converted into a two-step signal including special ON light emitting signal and OFF signal in accordance with the pixel size, and the converted signal is inputted to the laser driving circuit 24 so that the laser diode element is turned ON/OFF. As a typical method for binarization, there is a method in which the binarization signal is formed by an error diffusion technique and a dither technique on the basis of the image data, and, fundamentally, the time for generating the laser light is constant regardless of density. The difference is that the laser is emitted at low frequency for the pixel having low density and is emitted at high frequency for the pixel having high density.

The laser light driven and emitted in accordance with the image signal in this way is written on the photosensitive drum 1 in raster scan manner through a high speed rotating polygon mirror scanner 28 and a mirror 17*f* (FIG. 19), thereby forming the digital electrostatic latent image as image information.

Conventionally, many electrophotographic processes have been proposed as disclosed in U.S. Pat. No. 2,297,961, Japanese Patent Publication No. 42-23910 (1967) and Japanese Patent Publication No. 43-24748 (1968). In the general process, an electric latent image is formed on a photosensitive drum (recording member utilizing photo-electric material) by various means, and then the latent image is developed with toner (developer) to obtain a toner image which is in turn transferred onto a transfer material such as paper, and the toner image is fixed to the transfer material by heat or solvent vapor, thereby obtaining the copy image.

Further, various developing methods for visualizing the electric latent image by using the developer are already known. For example, there are magnetic brush development as disclosed in U.S. Pat. No. 2,874,063, powder cloud development as disclosed in U.S. Pat. No. 2,221,776, fur brush development and liquid electrophoretic development. Among such developments, particularly, although the magnetic brush development using two-component developer mainly including toner and carrier has widely been put to practice, this development can provide good image relatively stably, but has disadvantage inherent to the two-component developer such as deterioration of toner and change in mixing ratio between the toner and the carrier.

In order to eliminate the above disadvantages, various developments using one-component developer consisting of toner have been proposed. According to this development, since control of the mixing ratio of the toner to the carrier is not required, the apparatus can be made more simpler.

In the above-mentioned conventional examples, when a corona charger is used as means for uniformly charging the photosensitive member, ozone and nitrate (discharged substance) form a film on the photosensitive member. If the film absorbs moisture in the air, surface resistance of the photosensitive member is decreased not to hold the charges of the electrostatic latent image (after exposure) including the image information data, with the result that the image is flown along the surface to distort the image information partially or totally, thereby flowing the image as if aqueous ink is flown. Similarly, when a corona charger is also used as a post charger, the similar disadvantage of the smeared image due to ozone will arise. Similar disadvantage will occur in the transfer charger and the separating charger.

In the past, in order to eliminate the above disadvantage, although a method in which ozone gas is removed by sucking air from the interior of a shield case of each charger by a fan has been adopted, the ozone gas cannot be removed completely, with the result that substances adhered to the surface of the photosensitive member cannot be prevented from affecting a bad influence upon the photosensitive member, and, thus, the smeared image cannot be prevented.

Further, in an apparatus having a long service life and permitting high speed image formation, rubber material separated from a pick-up roller and a conveying roller which supply and convey a transfer paper is adhered to the paper as offset which may be brought up to the surface of the photosensitive member to be adhered thereto. If the offset is gradually accumulated for a long term use, similar to the above-mentioned coated substance, the smeared image will be caused.

In order to eliminate the above inconvenience, there has been proposed a technique in which developer is adhered to the photosensitive member and such developer is brought to a cleaning device to enhance a polishing effect of the surface of the photosensitive member.

However, it is required that the developer be supplied not during the image formation and longer time is required for polishing after the supplying. If the longer polishing time is prepared, the preparation starting time of the image forming apparatus will become very long. Particularly, in the laser scanning and exposing system, it takes a long time for bringing the number of revolutions of the polygon mirror to the predetermined and constant number of revolutions in comparison with a conventional analogue exposing system.

Particularly when a-Si photosensitive member is used as the photosensitive member under a high humidity environment, an amount of ozone discharged during long term use is increased, and, thereafter, if the apparatus is left as it is for a long term, the ozone substrate and the discharged substrate will be adhered to the surface of the photosensitive member and will absorb moisture, with the result that, after the image forming apparatus is firstly powered ON, the smeared image will occur in initial images.

Further, when the digital data is written on the photosensitive member by the laser or LED spot exposure, the smeared image is particularly noticeable. When the dimension of the laser spot has a diameter of 50 to 70 $\mu$m corresponding to 600 dpi, because of minute dots, even if the charges are disordered slightly, such disorder is integrated perceptionally as its collection and is felt further noticeably because of difference to the normal portion, thereby being recognized as great smeared image.

Further, in charge flying development and jumping development using one-component magnetic developer mainly utilizing electric field phenomenon, distortion of the electrostatic latent image on the photosensitive member is apt to be brought to the smeared image faithfully, and, particularly upon starting up of the image forming apparatus under the high humidity environment, the developer absorbs moisture while it is left as it is to reduce the surface resistance of the developer particles. As a result, since the charge amount of the developer to be held cannot be maintained to slightly decrease the developing efficiency, density reduction and smeared image are caused more noticeably. Such inconvenience is worsened in accordance with the moisture absorbed by the developing particles, and disadvantage occurs as reduction of density and/or smeared image in accordance with the humidity or water vapor amount in air.

Further, to eliminate the above disadvantages, there has been proposed a technique in which developer is adhered to the photosensitive member and such developer is brought to a cleaning device to enhance a polishing effect of the surface of the photosensitive member. However, in order to achieve the adequate polishing effect, it is required that a large amount of toner be supplied for the polishing or the toner be supplied frequently, with the result that, if the operator wants to obtain the small number of copies or prints, excessive developer will be consumed for the number of copies to be desired. That is to say, the cost for copy per one sheet will be increased or the toner will be consumed excessively.

SUMMARY OF THE INVENTION

The present invention aims to eliminate the above-mentioned conventional drawbacks, and an object of the present invention is to provide an image forming apparatus in which, even in first image formation early in the morning under a high humidity environment, a high quality image with high density and having no density unevenness can be formed without reduction in density and smeared image, and starting preparation time can be shortened.

The present invention aims to eliminate the above-mentioned conventional drawbacks, and an object of the present invention is to provide an image forming apparatus in which smeared image can be prevented and, if the operator wants to obtain the small number of copies, excessive developer is prevented from being consumed for the number of copies to be desired.

To achieve the above object, according to the present invention, there is provided an image forming apparatus for effecting image exposure on an electrophotographic photosensitive member by means of a digital optical system, comprising charging means for charging the electrophotographic photosensitive member, electrostatic latent image forming means for forming a minute dot pattern corresponding to image data, developing means for bearing developer on an developer bearing member to convey the developer to a developing portion opposed to the photosensitive member and for forming development electric field between the photosensitive member and the developer bearing member in the developing portion to develop the latent image on the photosensitive member with the developer, transfer means for transferring the developer image onto a transfer material, fixing means for fixing the developer image transferred to the transfer material, photosensitive member surface cleaning means for cleaning residual developer remaining on the surface of the photosensitive member after the transferring, means for detecting a temperature of the fixing means, and means for detecting a water vapor amount in a surrounding environment, and wherein, when a power supply of the apparatus is powered ON, if the fact that the temperature of the fixing means is a predetermined temperature or larger is detected and if the fact that water vapor amount in the surrounding environment is a predetermined water vapor amount or larger is detected, in a condition that preparation of a starting operation of the electrostatic latent image forming means for image formation is not completed, the charging means, optical system means for forming the minute dot pattern or minute line pattern, the developing means and the photosensitive member surface cleaning means are operated to polish the photosensitive member.

Further, the present invention provides an image forming apparatus for effecting image exposure on an electrophotographic photosensitive member by a digital optical system, comprising charging means for charging the electrophotographic photosensitive member, electrostatic latent image forming means for forming a minute dot pattern corresponding to image data, developing means for bearing developer on an developer bearing member to convey the developer to a developing portion opposed to the photosensitive member and for forming development electric field between the photosensitive member and the developer bearing member in the developing portion to develop the latent image on the photosensitive member with the developer, transfer means for transferring the developer image onto a transfer material, fixing means for fixing the developer image transferred to the transfer material, photosensitive member surface cleaning means for cleaning residual developer remaining on the surface of the photosensitive member after the transferring, means for detecting a temperature of the fixing means, and means for detecting a water vapor amount in a surrounding environment, and wherein a first step is effected in such a manner that, when a power supply of the apparatus is powered ON, if the fact that the temperature of the fixing means is a predetermined temperature or lower is detected and if the fact that water vapor amount in the surrounding environment is a predetermined water vapor amount is larger is detected, in a state that preparation of a starting operation of the electrostatic latent image forming means for image formation is not completed, the charging means, optical system means for forming the minute dot pattern or minute line pattern, the developing means and the photosensitive member surface cleaning means are operated to polish the photosensitive member; and thereafter, a second step is effected in such a manner that the developing means and the photosensitive member surface cleaning means including the driving of the photosensitive member are operated in a state that the image formation is not effected; and a third step which is a preparing operation as a preprocess for normal image formation in a state that the water vapor amount is smaller than the predetermined water vapor amount is effected at a time when the temperature of the fixing means reaches a fixing permitting temperature; and, when a second predetermined water vapor amount range is detected, the second and third steps are effected; and, when a third predetermined water vapor amount range is detected, the second step is not effected but the third step is effected.

The present invention further provides an image forming apparatus for effecting image exposure on an electrophotographic photosensitive member by a digital optical system, comprising charging means for charging the electrophotographic photosensitive member, electrostatic latent image forming means for forming a minute dot pattern corresponding to image data, developing means for bearing developer on an developer bearing member to convey the developer to a developing portion opposed to the photosensitive member and for forming development electric field between the photosensitive member and the developer bearing member in the developing portion to develop the latent image on the photosensitive member with the developer, transfer means for transferring the developer image onto a transfer material, fixing means for fixing the developer image transferred to the transfer material, photosensitive member surface cleaning means for cleaning residual developer remaining on the surface of the photosensitive member after transferring, means for detecting a temperature of the fixing means, means for detecting a water vapor amount in a surrounding environment, and control means for controlling an image forming operation, and wherein the means for controlling the image forming operation serves to judge as a large amount using condition of the image forming apparatus and to form a toner image for abrading the surface of the photosensitive member on the photosensitive member with a normal amount of toner under a high humidity environment if a difference between the total number of used transfer materials in the image forming apparatus when the temperature of the fixing means detected by the temperature detecting means upon power ON of a power supply is a predetermined temperature or lower and if the water vapor amount in the surrounding environment detected by the water vapor amount detecting means is a predetermined water vapor amount or larger and the previous total number of transfer materials under the same condition is a predetermined number or more, and to judge as a small amount using condition if the difference is smaller than the predetermined number and to form a toner image for polishing the surface of the photosensitive member on the photosensitive member with an amount of toner smaller than the normal amount under the high humidity environment.

DESCRIPTION OF THE PREFERRED EMBODIMENTS

The present invention will now be fully explained in connection with embodiments thereof with reference to the accompanying drawings.

First Embodiment

Figure 1:
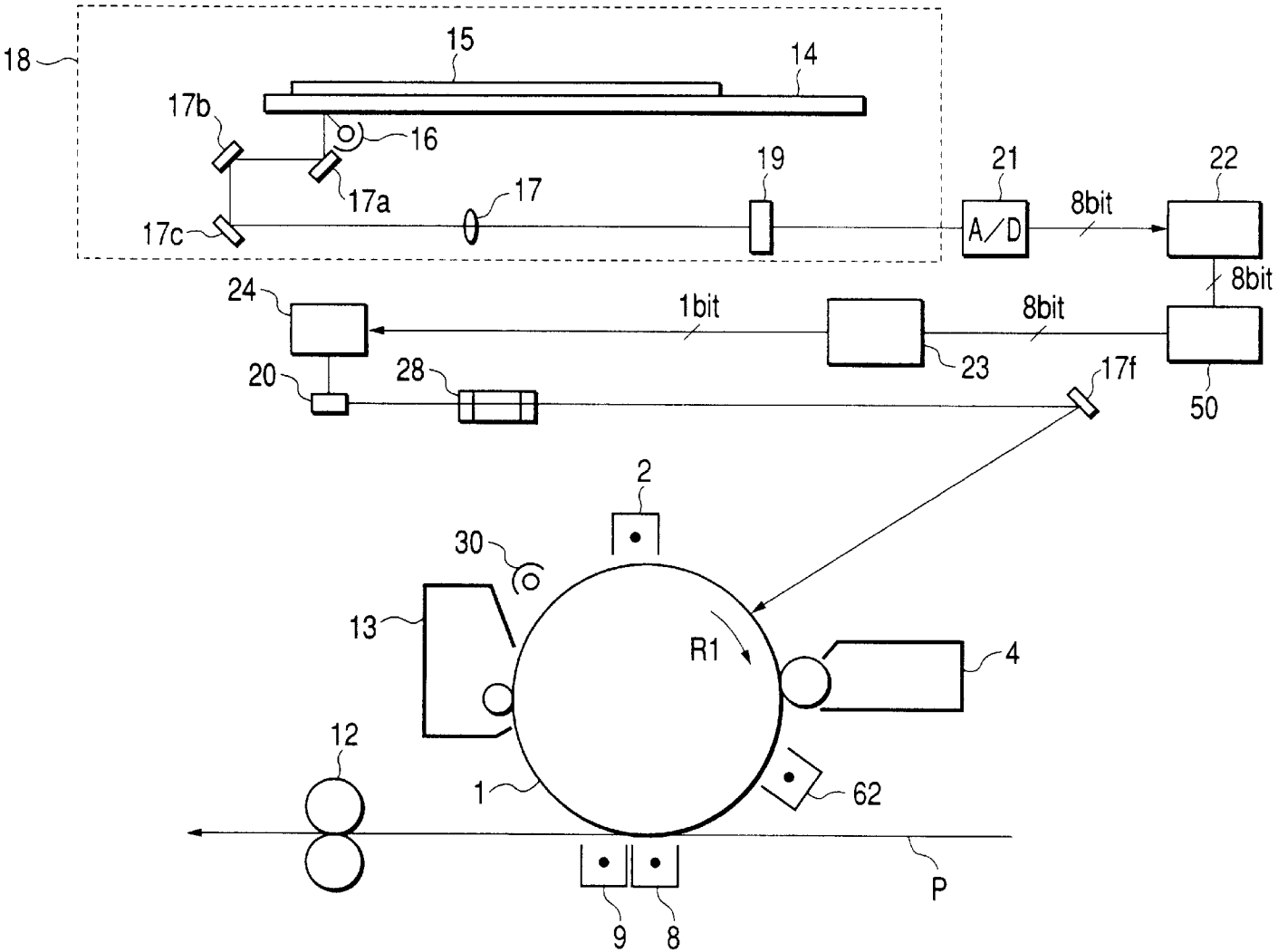
FIG. 1 is a schematic constructural view of an image forming apparatus according to a first embodiment of the present invention.

FIG. 1 is a schematic constructural view of an image forming apparatus according to a first embodiment of the present invention.

A photosensitive drum 1 as a photosensitive member is constituted by coating a photoconductive layer on a cylindrical conductive substrate and is supported for rotation in a direction shown by the arrow R1. Around the photosensitive drum 1, there are disposed, in order along a rotational direction thereof, a scorotron charger 2 for uniformly charging a surface of the photosensitive drum 1, an exposure device for reading an original and for forming an electrostatic latent image by exposing the photosensitive drum 1 in accordance with an image signal proportional to image density, a developing device 4 for forming a toner image by adhering toner to the electrostatic latent image, and a developer charge amount controlling charger (referred to as "post charger" hereinafter) 62 for adjusting a toner charge amount of a toner image on the photosensitive drum 1 after development so as to improve a transfer efficiency. Further, there is also provided a conveying system for conveying a transfer sheet P to a corona transfer charger (transfer charger) 8. Furthermore, there are provided the transfer charger 8 for transferring the toner image formed on the photosensitive drum 1 onto the transfer sheet P, an electrostatic separating charger (separating charger) 9 for separating the transfer sheet P to which the toner image was transferred from the photosensitive drum 1, a cleaning device 13 for removing residual toner from the photosensitive drum 1 after the toner image transferring, and a pre-exposure (lamp) 30 for eliminating residual charge on the photosensitive drum After separated from the photosensitive drum 1, the transfer sheet P on which the toner image is transferred is conveyed to a fixing device 12, where the toner image is fixed to the transfer sheet to obtain a desired print image, and the transfer sheet P to which the toner image was fixed is discharged out of a main body of the image forming apparatus.

By the way, in a reader portion 18, an original 15 rested on an original glass stand 14 is illuminated by an illumination lamp 16, and light reflected from the original is imaged on a photo-electric converting element (one-line CCD) 19 to convert the light into an electrical signal corresponding to image information. The light reflected from the original 15 illuminated by the illumination lamp 16 is imaged on the photo-electric converting element 19 through mirrors 17*a*, 17*b*, 17*c* and a lens 17*d*. The electrical signal outputted from the photo-electric converting element 19 is A/D-converted by an A/D-converter 21 into an 8-bit digital image data which is in turn logarithmically transformed in a black signal generating circuit 22 for changing luminance information to density information to obtain image density data.

The image density data (8-bit digital image data signal) formed in this way is converted into a two-step signal including special ON light emitting signal and OFF signal in accordance with the pixel size in a binarizing circuit 23 and then is inputted to a laser driving circuit 24. After the driving electric current is subjected to dot reproducing correction, a laser diode is turned ON/OFF at a timing of a driving signal binarized by the error diffusion method in accordance with the magnitude of the inputted image density signal.

Incidentally, in the illustrated embodiment, while an example that the binarizing circuit 23 is realized by the error diffusion method was explained, a dither method or other methods may be used. Further, the laser driving circuit 24 may be a well-known PWM circuit which modulates a light emitting time for ON/OFF of a laser diode in accordance with magnitude of the image density signal inputted, after the driving electric current is subjected to the dot reproducing correction.

Figure 5A:
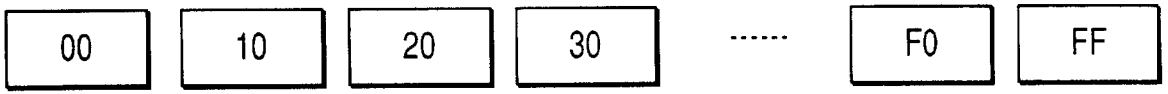
FIGS. 5A and 5B are explanatory views for explaining an operation of the light source driving circuit.
Figure 5B:
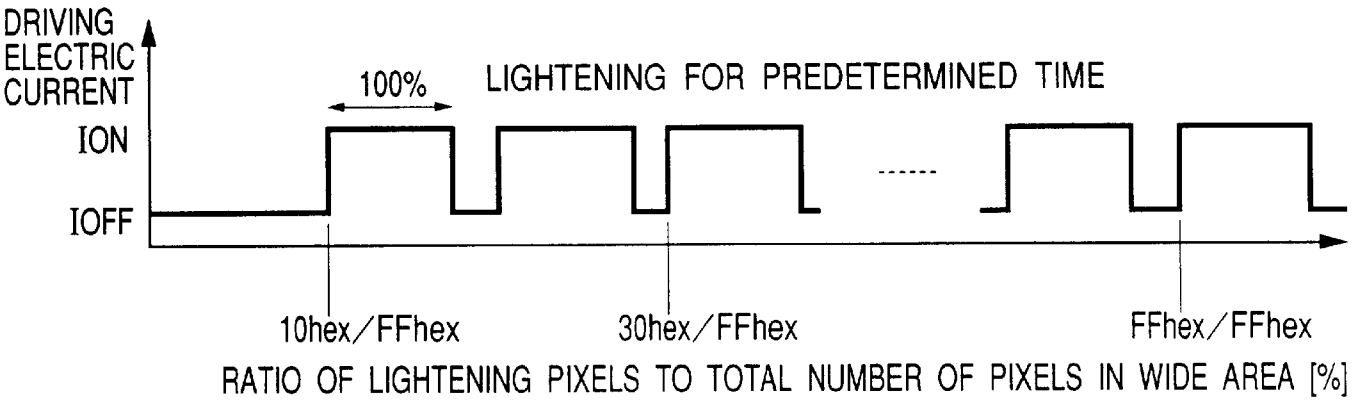

For example, briefly explaining the laser lightening of the binary image data, when the image data per pixel is inputted in a laser scanning direction as shown in FIG. 5A, a driving signal for ON/OFF of the laser becomes as shown in FIG. 5B. Thus, although the laser is lightened by the predetermined driving electric current regardless of the image data, a ratio of lightening pixels to total number of pixels in predetermined plural pixel areas is varied with the image data, and exposure density in the plural pixel areas is modulated. That is to say, when the image data is 00 hex, ON number of the laser driving signal is regarded as 0% of the ratio of lightening pixels to total number of pixels in the predetermined plural pixel areas, and when the image data is FF hex, ON number of the laser driving signal is regarded as 100% of the ratio of lightening pixels to total number of pixels in the predetermined plural pixel areas. However, even when the ratio of lightening pixels is 0%, constant driving electric current flows as bias electric current, thereby slightly lightening the pixels. The tone (dark/light) is achieved by effecting area-gradation within the predetermined plural pixel areas in this way.

Figures 4A, 4B, 4C:
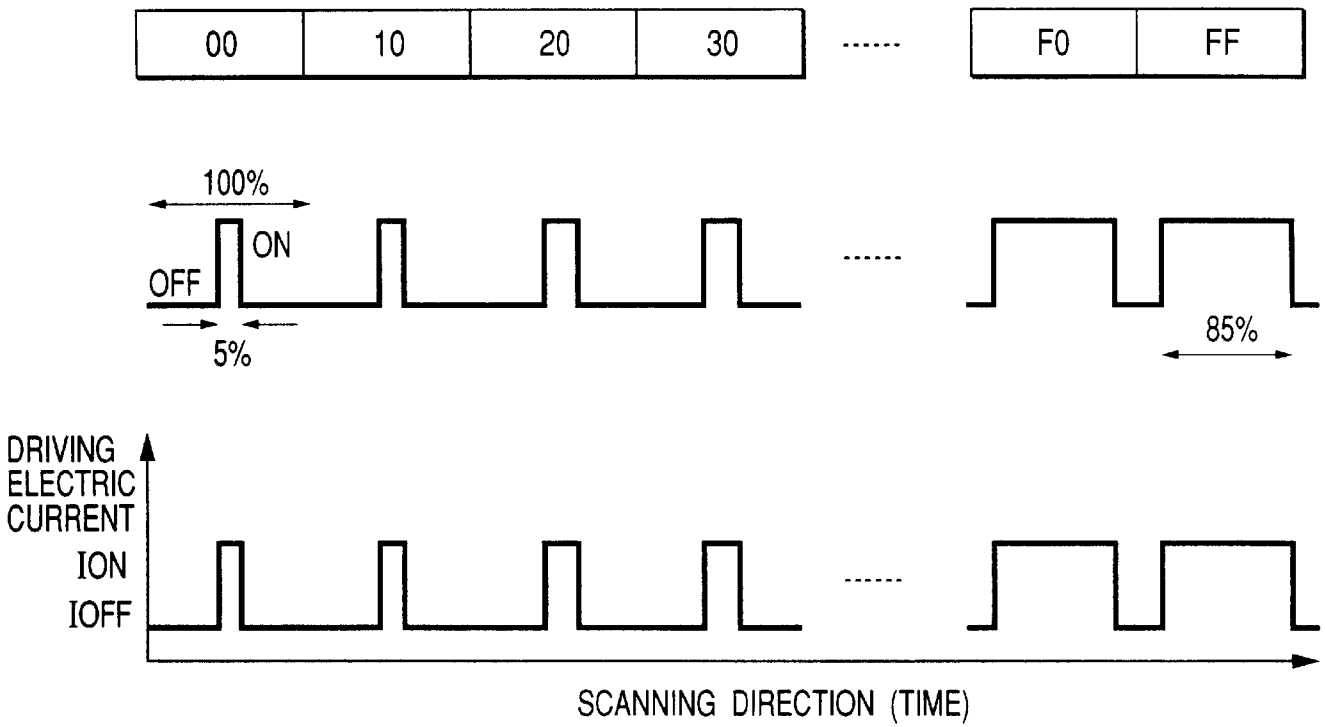
FIGS. 4A, 4B and 4C are explanatory views for explaining an operation of the light source driving circuit.

Further, as shown in FIGS. 4A to 4C, a PWM system may be used, of course. When the image data per pixel is inputted in a laser scanning direction as shown in FIG. 4A, a driving signal for ON/OFF of the laser becomes as shown in FIG. 4B. That is to say, ON duty of the laser driving signal when the image data is 00 hex is selected to 5% of one pixel scanning time, and ON duty of the laser driving signal when the image data is FF hex is selected to 85% of one pixel scanning time. The tone (dark/light) is achieved by effecting area-gradation within one pixel in this way.

Figure 3:
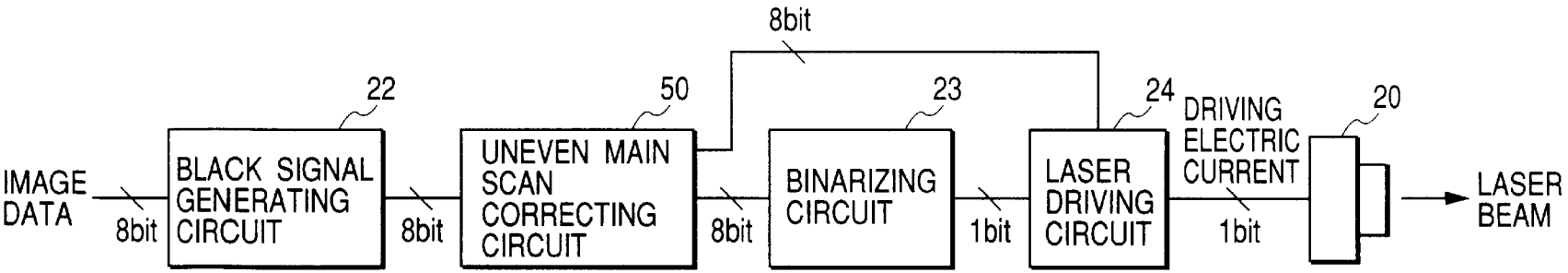
FIG. 3 is a block diagram showing a light source driving circuit.
Figure 6:
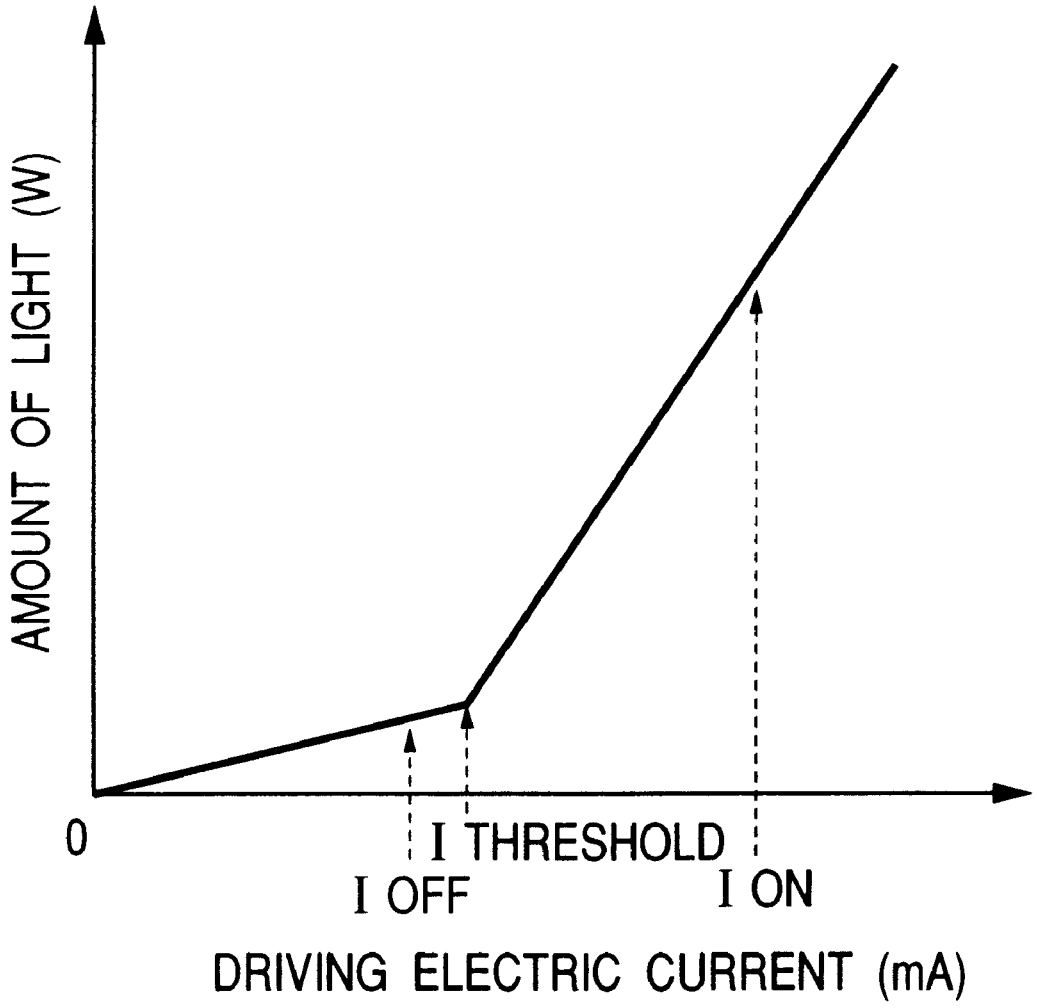
FIG. 6 is a view showing a relationship between an amount of light and driving electric current.

Further, FIG. 6 shows general I–L property (driving electric current–amount of light property of the laser. Since the driving electric currents used for ON and OFF of the laser are $I_{on}$ and $I_{off}$, respectively, the laser driving signals for the image signals of FIGS. 5A and 4A become as shown in FIGS. 4B and 4C, which are currents for driving the laser through the binarizing circuit 23 shown in FIG. 3, PWM circuit (not shown) and laser driving circuit 24. In this case, as shown in FIG. 6, it is known that the rising of the amount of light upon ON of laser can be improved by setting the current to a value slightly smaller than $I_{threshold}$, rather than 0 mA. Incidentally, as the laser, a visible light laser having a wavelength of 680 nm is used.

Figure 19:
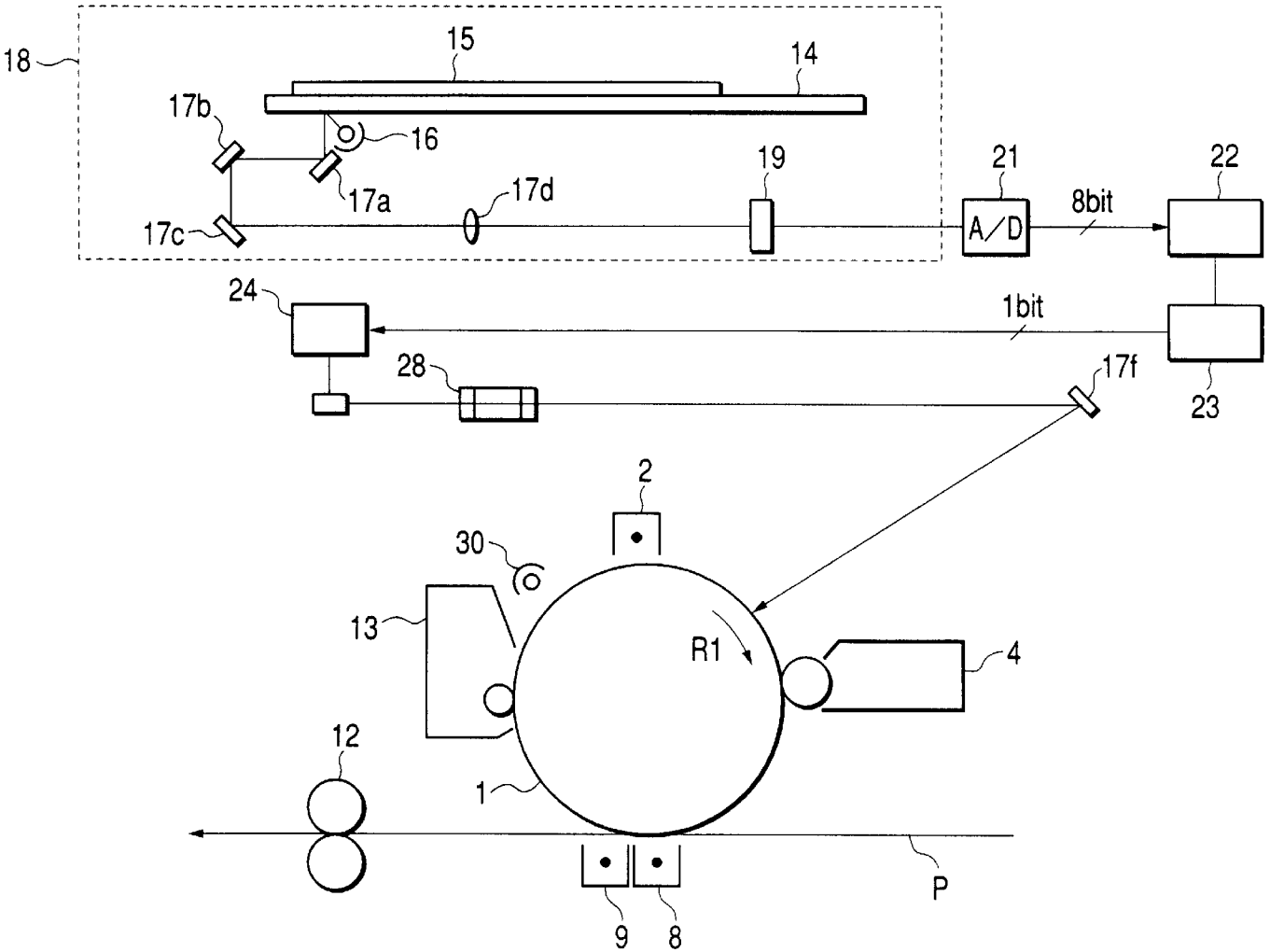
FIG. 19 is a schematic constructural view of a conventional image forming apparatus.

The laser light driving and emitted in accordance with the image signal in this way is written on the photosensitive drum 1 in raster scan manner through a high speed rotating polygon mirror scanner 28 shown in FIG. 1 and a mirror 17*f* (FIG. 19), thereby forming the digital electrostatic latent image as image information.

In the illustrated embodiment, an amorphous silicon (a-Si) drum is used as the photosensitive drum 1. The amorphous silicon drum has advantage that conductive substrate has highly stable property and high endurance and long service life can be achieved. Since the a-Si photosensitive member having a surface layer of SiC cure type achieving long service life and high speed output and a photosensitive layer having high photo-sensitivity has high charge holding ability and less scattering of illumination light incident on the surface layer, the minute electrostatic latent image of the minute spot exposed portion obtained by laser illumination is held without diffusion of charges, so that a minute latent image such as 600 dpi or 1200 dpi can be formed faithfully, thereby forming a high fine latent image.

Figure 2A:
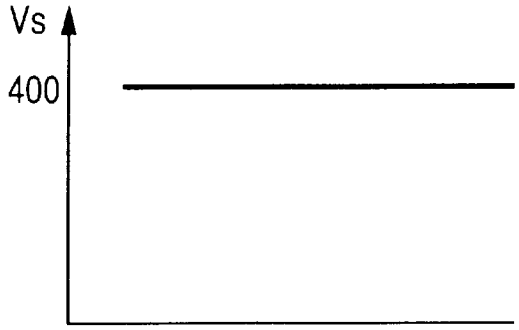
FIGS. 2A, 2B and 2C are views showing surface potential of a photosensitive drum in image formation.
Figure 2B:
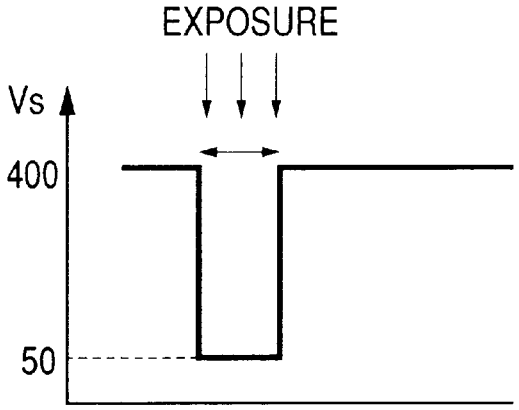
Figure 2C:
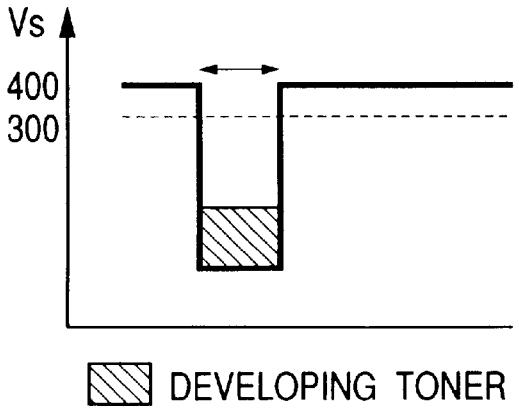

FIGS. 2A to 2C show steps for explaining the image forming process according to the illustrated embodiment. In these Figures, a relationship between surface potential $V_s$ of the photosensitive drum 1 and developing bias is schematically shown.

In FIG. 2A, the photosensitive drum 1 is uniformly charged with +420 V by the scorotron charger 2.

In FIG. 2B, the exposure of the image information is effected so that the surface potential of the image information exposed portion is decreased to +50 V, thereby forming the electrostatic latent image. Since the image exposure is effected by pulse-width-modulated light amount, although the actual potential $V_s$ of the photosensitive drum after exposure includes, in principle, only a potential of laser OFF portion and potential of a laser ON portion, in a general surface potentiometer of non-contact type for measuring integrated potential in a sufficiently wide area in comparison with a spot diameter of the laser, the potential is measured as intermediate gradient potential apparently. That is to say, since a non-imaged portion (image data=00 hex) of the image area is also slightly exposed, the surface potential $V_s$ is decreased to +400 V, and the surface potential $V_s$ of an imaged portion (image data=FF hex) of the image area is decreased to +50 V, thereby forming the electrostatic latent image.

Then, in FIG. 2C, by applying developing bias voltage (for example, voltage obtained by superimposing DC voltage of +280 V on AC voltage; DC voltage component is shown by the broken line) to a sleeve of the developing device 4, the exposure portion is reverse-developed. Here, the developing device 4 effects development by using well-known one-component magnetic toner in such a manner that the sleeve is not contacted with the photosensitive drum 1.

Hereinbelow, an smeared image preventing sequence which is one of characteristics of the present invention is shown. Conditions of the sequence for each purpose are as follows:

EXAMPLE 1

HH First Early in the Morning Idle Rotation+Toner Black Belt

Where, HH First Early in the Morning represents to operate the apparatus first in the morning under a high temperature and high humidity condition. Idle Rotation represents to rotate a photosensitive drum previously before actually forming an image to set a charge and a developing bias appropriately. Toner Black Belt represents to form a belt-shaped toner image in a longitudinal direction of the photosensitive drum lest a cleaning blade should be curled up due to a friction between the cleaning blade and the photosensitive drum.

Purpose: Flow Substance Removal (Scraping) for Countermeasure to a Smeared Image Summary: When a fixing thermistor temperature (temperature detected by a thermistor fixed to the fixing device) upon switched-ON of a main switch is a predetermined temperature (or lower) and an environment is above a predetermined water vapor amount, it is judged as First Early in the Morning and high humidity environment, and the Idle Rotation of the drum is started and substantially at the same time primary-charging, laser exposure and development are effected on the drum, thereby forming a toner black belt.

Conditions (1) First Early in the Morning judgement: the fixing thermistor temperature upon ON of the main switch is 120° C. or lower (2) HH (high temperature and high humidity) judgement: the water vapor amount is 16 g or more (3) Idle Rotation time: From immediately after the First Early in the Morning HH judgement to the fixing thermistor temperature of 195° C., the Idle Rotation is effected for about 4.5 minutes (The rotation time is varied with fixing thermistor temperature upon initiation of the Idle Rotation).

(4) Primary charge: Output having a control value in yesterday (if no data, default output). The output time is a time corresponding to a width of the black belt.

(5) Laser: Output having a power control value in yesterday. Solid output (The solid output and "black copy" are the same. The solid output is not halftone, but a black image which is black itself.) of image area with FF hex. The output time is a time corresponding to the width of the black belt.

(6) Development: Output having a DC control value in yesterday. AC+DC (if no data, default output). The output time is a time corresponding to a width of the black belt. DC value can be inputted. Black belt density is variable.

(7) Black belt width: 100 mm on the surface of the drum (50, 200 or 400 mm can selectively be inputted. Further, voluntary input is permitted for variable width).

(In the tests, it was ascertained that, regarding the black belt width of about 84 mm, the flow is eliminated by effecting the Idle Rotation for three minutes.)

EXAMPLE 2

HH, JJ (Normal Temperature & Normal Humidity), NL (Normal Temperature & Low Humidity) First Early in the Morning Toner Black Belt+Idle Rotation and its Variations Purpose: Maintaining of Density Upon Disposal Under High Humidity and Smeared Image Prevention Summary: When a fixing thermistor temperature upon ON of a main switch is a predetermined temperature or lower and an environment is a predetermined water vapor amount or lower, it is judged as First Early in the Morning and high humidity environment (and each environment), and the Idle Rotation of the drum (developing device and a cleaner system (cleaning device)) is started and substantially at the same time primary-charging, laser exposure and development are effected on the drum, thereby combining with the formation of a Toner Black Belt.

(a) First Early in the Morning Black Belt+Idle Rotation: Water vapor amount W≧9 g (b) First Early in the Morning Idle Rotation: Water vapor amount 9 g>W≧5 g (c) Normal Pre-Multi Rotation Only: Water vapor amount less than 5 g Normal Pre-Multi Rotation Only represents operations which are performed while operating the photosensitive member, charging and development to set image forming conditions immediately before the normal image formation.

Conditions:

(1) First Early in the Morning Judgement: the fixing thermistor temperature upon switched-On of the main switch is 100° C. or lower.

(2) HH Judgement:

(a) First Early in the Morning Black Belt+Idle Rotation: Water vapor amount W>9 g (b) First Early in the Morning Idle Rotation: Water vapor amount 9 g>W≧5 g (c) Normal Pre-Multi Rotation Only: Water vapor amount less than 5 g (3) Idle Rotation time: From immediately after the First Early in the Morning HH judgement to the fixing thermistor temperature of 195° C., the Idle Rotation is effected for about 4.5 minutes (The rotation time is varied with fixing thermistor temperature upon initiation of the Idle Rotation).

(4) Primary charge: Output having a control value in yesterday (if no data, default output). The output time is a time corresponding to a width of the black belt (a time for forming a toner black belt image).

(5) Laser: Output having a power control value in yesterday. Solid output of image area with FF hex. The output time is a time corresponding to the width of the black belt.

(6) Development: Output having a DC control value (in particular, a DC (superimposed component of direct current) voltage value of a developing bias (AC+DC) used on outputting actual images in yesterday) in yesterday. AC+DC (if no data, default output). the output time is a time corresponding to a width of the black belt. DC value can be inputted. Black belt density is variable. (It is possible to change in density of a toner image constituting the "black belt".)

(7) black belt:

Sub-scanning direction length: 400 mm on the surface of the drum.

Input is permitted.

Main scanning direction length: Denomination width of A3 width parted down in the center of image area (not including lateral registration tolerance, and registration tolerance of image area and transfer sheet area in the drum axial direction)

Timing: Substantially the same as initiation of Idle Rotation JJ First Early in the Morning density in Toner Black Belt+Idle Rotation is improved from 1.2 to 1.32 (It was ascertained that, regarding the black belt width of about 84 mm, the smeared image is eliminated by effecting the Idle Rotation for three minutes.)

Figure 21:
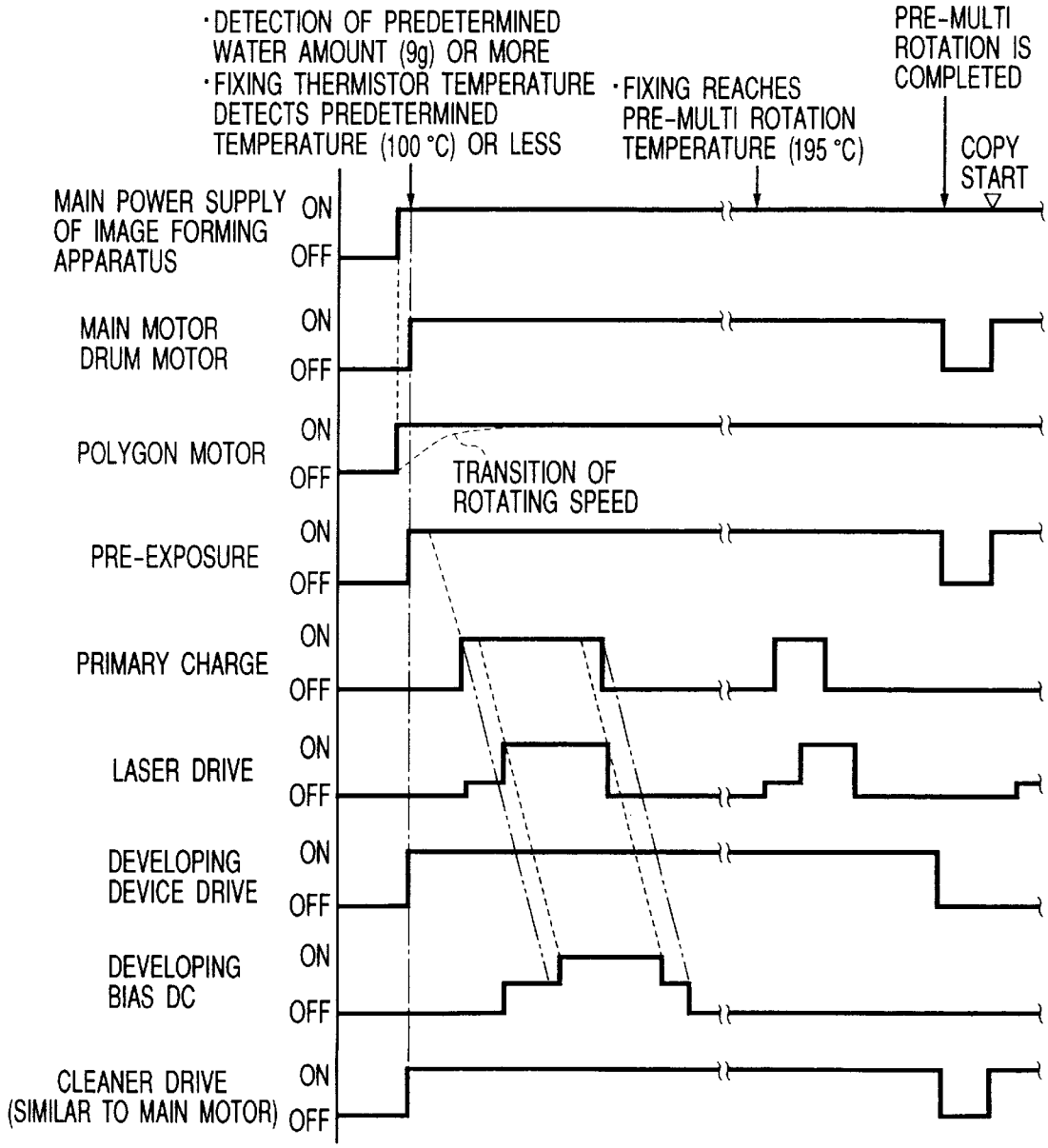
FIG. 21 is a sequence view of an image forming apparatus according to the present invention.

Now, an operation in <Example 2> according to the present invention will be explained in order with reference to FIG. 21.

When the fact that the fixing thermistor temperature upon switched-ON of the main switch is 100° C. or lower is detected and the fact that the environment is the predetermined water vapor amount (water vapor amount W≧9 g) is detected, it is judged as First Early in the Morning and high humidity environment (a), and a drum driving motor is operated to effect the Idle Rotation of the drum, and, at the same time, a developing device driving motor is operated to rotate a sleeve of the developing device, and, at the same time, a cleaner system driving motor is operated to effect the Idle Rotation of the cleaner system. Further, upon switched-ON of the main switch, the rotation driving of the polygon mirror in a laser scanning system starts the operation simultaneously.

Further, substantially at the same time, the primary charging is effected on a position of the drum corresponding to a pre-exposure position upon initiation of the Idle Rotation. Regarding the charging amount, output is effected by using the control value in yesterday, i.e., the last potential control value when the power supply was previously powered ON. Further, if there is no previous data, output is effected with a program default value. The output time is a time corresponding to the width of the black belt, and slight margin charging areas are provided before and after the black belt. In total, the output time corresponds to 400 mm or more in a circumferential direction of the drum. Regarding a length in the main scanning direction, the charging is effected on an area greater than the denomination width of A3 width parted down in the center of the dot area.

Then, the laser exposure is started even when the number of revolutions of the polygon mirror does not reach the predetermined number of revolutions. Namely, regarding the beam illumination pattern on the drum, first of all, starting from a pattern in which minute dots and blanks are repeated alternately, lengths of the dots and blanks are gradually shortened to ultimately provide a continuous minute line pattern. Regarding the lightening of the laser, output is effected with the previous power control value. Further, if there is no previous data, output is effected with the program default value. As the image data level, solid output of the image area is effected with FF hex. The length in the main scanning direction is the denomination width of A3 width parted down in the center of the image area. Namely, the laser beam scanning is effected in the width not including adjusting tolerance of main scanning direction registration (lateral registration). Here, FF hex output of image area of 297 mm is effected. The output time is a time corresponding to the width of the black belt, and is a time corresponding to 400 mm in the circumferential direction on the drum in the illustrated embodiment. Further, in order to hasten the rising of the laser output before FF hex is outputted, bias current is flown to slightly lighten the laser.

Then, in the development, although AC voltage+DC voltage is outputted, AC voltage is outputted with standard voltage and DC voltage is outputted with a previous DC control value. In the illustrated embodiment, although the black belt width is the DC control value of 280 V, in order to completely cover the area (before and after the black belt width) in which the primary-charge is outputted, DC control value of 300 V for the non-image area is outputted to minimize reverse-development in the area subjected to the primary-charging alone. Although FIG. 21 shows only DC voltage, AC voltage is ON in the area further covering the DC voltage area (non-imaged area). Further, if there is no previous data, DC control value output is effected with the program default value. The output time is a time corresponding to the width of the black belt, and is a time corresponding to 400 mm in the circumferential direction on the drum in the illustrated embodiment. The DC value can be inputted through an operation panel and is set so that the darkness of the black belt can be changed.

After the toner belt is formed on the drum, the Idle Rotation process is performed. In an early initial phase of this process, the toner black belt is brought up to the drum cleaning device, where the black belt is stopped by an edge of a cleaning blade and laminated substances on the surface of the drum is scraped off by the toner accumulated here. Since the scraping effect is proportional to the abrading time, in order to provide the longest time, the formation of the black belt is started prior to the rising of the laser polygon mirror, thereby reserving the time. When the formation of the black belt is included, this rotation is continued from immediately after the First Early in the Morning HH judgement to the fixing thermistor temperature of 195° C. and is continued for about 4.5 minutes until the Normal Pre-Multi Rotation is started.

However, the rotation time is varied with the fixing thermistor temperature upon initiation of the Idle Rotation. For example, when the rotation is started from the fixing thermistor temperature of about 90° C., since a time period required for increasing the temperature is short, the rotation time is reduced accordingly. In this case, since the fixing thermistor temperature is greater than a room temperature, in actual, there is an ample possibility for no First Early in the Morning, and, thus, since long time Idle Rotation is not required (there is no problem), it is regarded as maximum time Idle Rotation in that condition. Further, in this case, the Idle Rotation of the developing device is also effected, so that the charging amount of the developer in which the rising of the charging amount becomes difficult due to moisture absorption is gradually increased, with the result that the adequate density can be achieved until the Pre-Multi Rotation is reached, and the developing ability is increased sufficient to adequately preserve reproducing ability of individual dot. As a result, in a copy image obtained in the condition of the First Early in the Morning under the high humidity environment, there is no smeared image, thereby obtaining a uniform high quality image with high density.

As mentioned above, regarding the smeared image, even in the most severe high humidity environment (having water vapor amount of 9 g/m$^3$), the good image can be obtained from immediately after the starting of the image forming apparatus regardless of the environment.

Hereinbelow, a method for correcting unevenness in the main scanning direction caused when uneven density in the developing device or other uneven density is generated will be fully described.

Figure 7A:
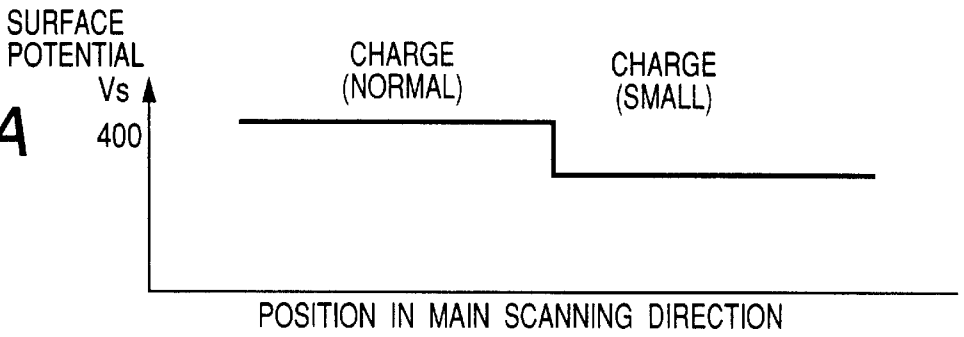
FIGS. 7A, 7B and 7C are views showing surface potential of a photosensitive drum in image formation.
Figure 7B:
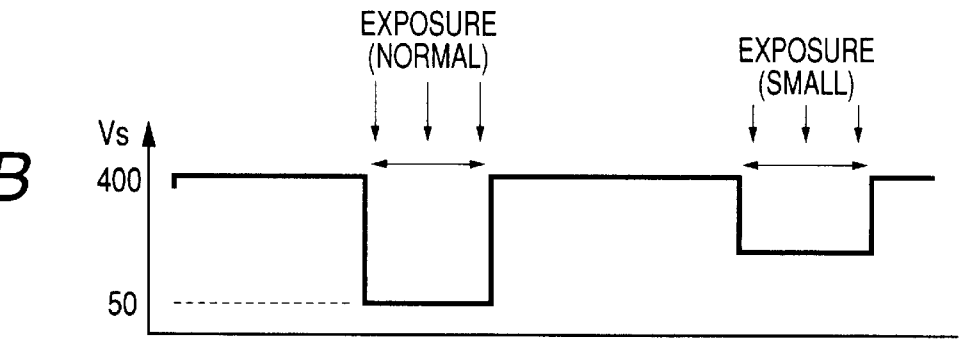
Figure 7C:
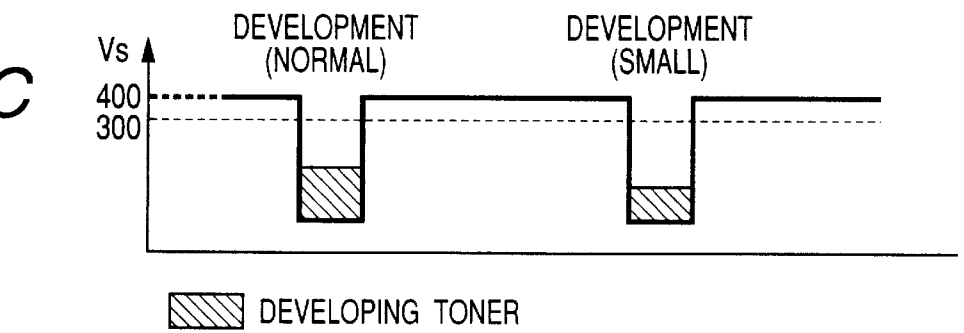

FIGS. 7A to 7C are schematic views for analyzing factors for generating the uneven density in the main scanning direction. The ordinate indicates the surface potential $V_S$ on the photosensitive drum and the abscissa indicates any position in the main scanning direction.

Figure 8:
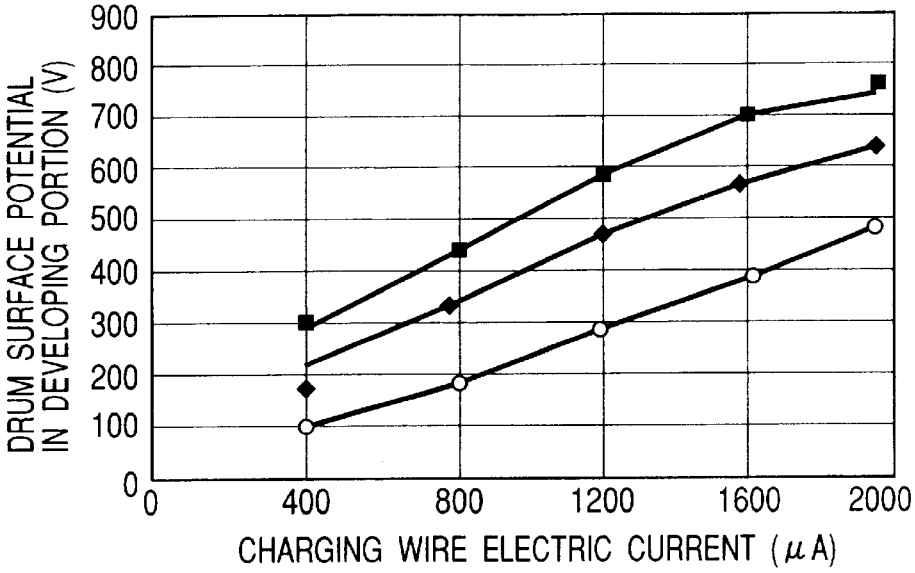
FIG. 8 is a view showing a relationship between drum surface potential in a developing portion and charging wire electric current.

FIG. 7A shows potential values in a location where the charging potential is correctly obtained as target potential of 400 V and a location where the charging potential is smaller than the target potential. This is surface potential unevenness generated due to the fact that, regarding the charging ability property of the photosensitive drum, properties of the surface potential obtained on the photosensitive drum with respect to the corona wire applying electric current of the primary charger are differentiated, as shown by three kinds of property curves in FIG. 8. Further, even when the charging ability property of the photosensitive drum is uniform, if the charging ability of the primary charger is uneven in the main scanning direction, the surface potential unevenness will be generated.

Figure 9:
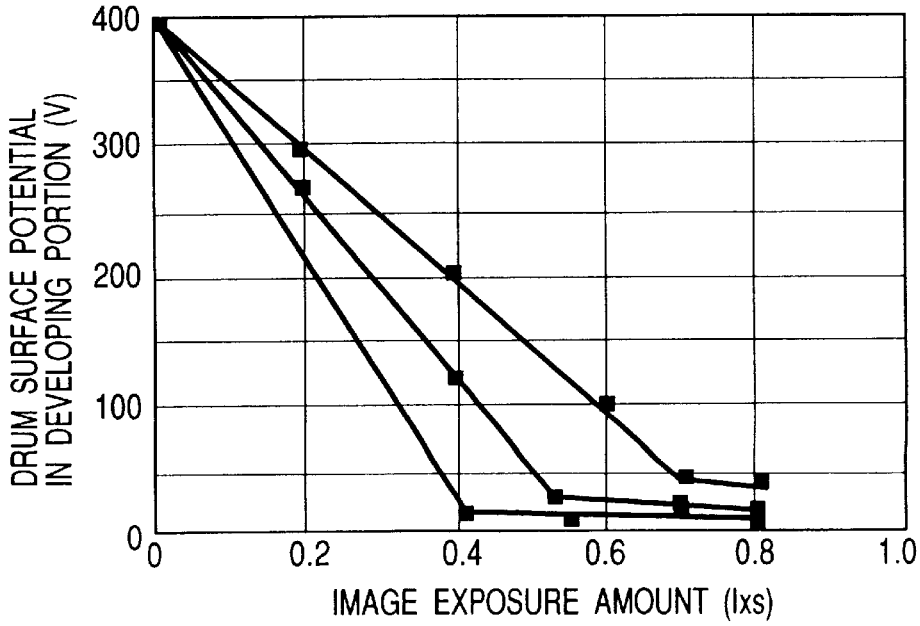
FIG. 9 is a view showing a relationship between drum surface potential in a developing portion and an image exposure amount.

FIG. 7B shows potential values in a location where the potential is correctly obtained as target potential of 50 V of the exposure portion and a location where the charging potential is greater than the target potential, when the surface potential formation due to the charging is effected uniformly. This is surface potential unevenness generated due to the fact that the charging ability properties of the photosensitive drum are differentiated, as shown by three kinds of property curves in FIG. 9. Further, even when the photosensitivity property of the photosensitive drum is uniform, if the amount of illumination light is uneven in the main scanning direction, the surface potential unevenness will be generated.

Figure 10:
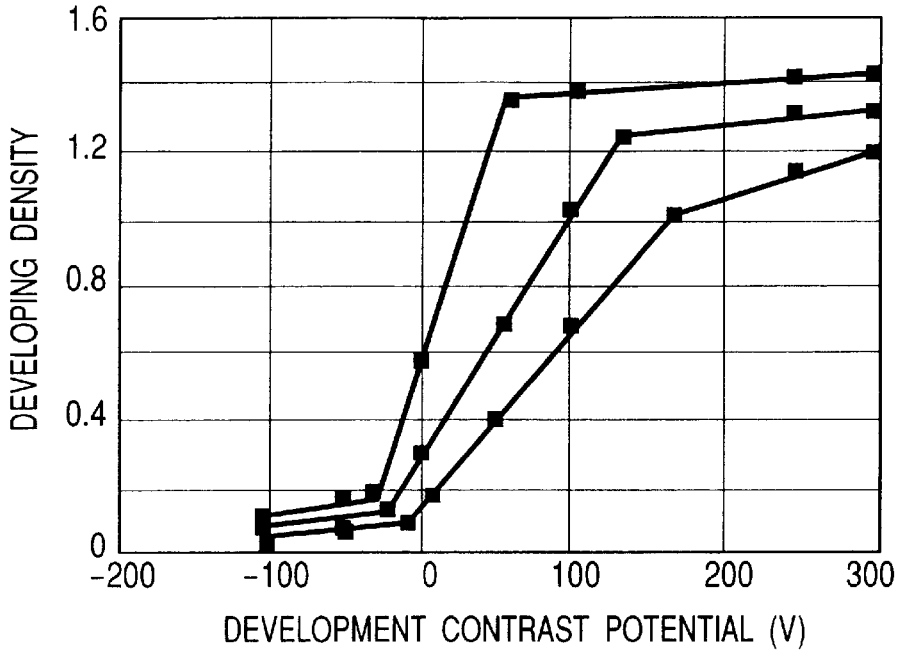
FIG. 10 is a view showing a relationship between developing density and developing contrast potential.

FIG. 7C shows potential values in a location where the development is correctly effected at target potential of 50 V of the exposure portion and a location smaller than the target potential, when the surface potential formation due to the charging and the surface potential formation due to reduction in potential by an exposure are effected uniformly. This is surface potential unevenness generated due to the fact that the developing abilities are differentiated with respect to developing contrast which is a difference between the surface potential of the photosensitive drum and DC voltage applied to the development sleeve for bearing and conveying developing toner, as shown by three kinds of property curves in FIG. 10. This uneven density is generated if the charging property of the toner is uneven in the main scanning direction or if a gap between the photosensitive drum and the development sleeve is uneven in the main scanning direction.

Further, there is uneven density caused if the transfer efficiency in the transferring and separating (not shown) is uneven in the main scanning direction. In the illustrated embodiment, all of the above-mentioned factors for generating unevenness are detected synthetically and correction is effected.

Figure 12:
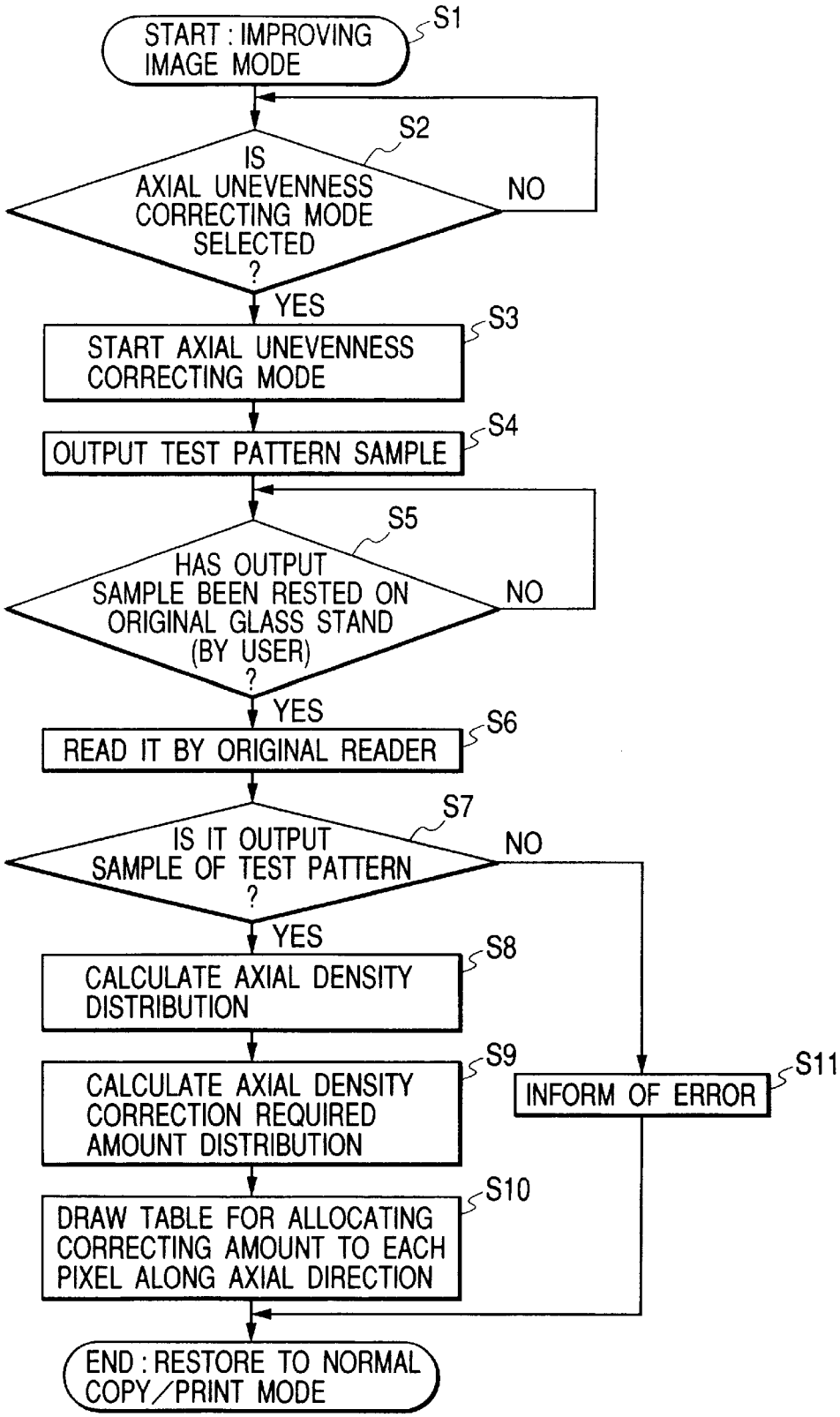
FIG. 12 is a flowchart showing uneven density correcting sequence.

FIG. 12 schematically shows a flow chart for the correcting operation.

Step 1: The image forming apparatus according to the illustrated embodiment has an "Improving Image Mode" for improving the image unevenness at its input interface. First of all, such a mode is started.

Step 2: Then, an axial unevenness (unevenness in the main scanning direction) correcting mode is selected.

Step 3: A key for starting the axial unevenness correcting mode is depressed to start such a mode.

Figure 11:
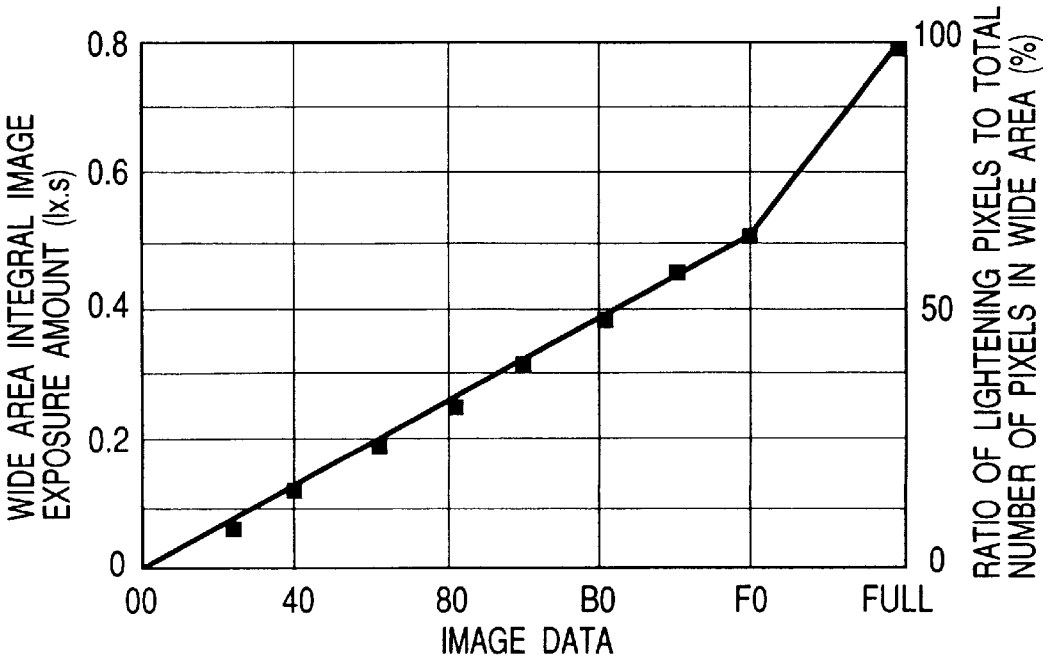
FIG. 11 is a view showing a relationship between a wide area integral image exposure amount and a ratio of lightening pixels to total number of pixels in wide area, and image data.
Figure 13A:
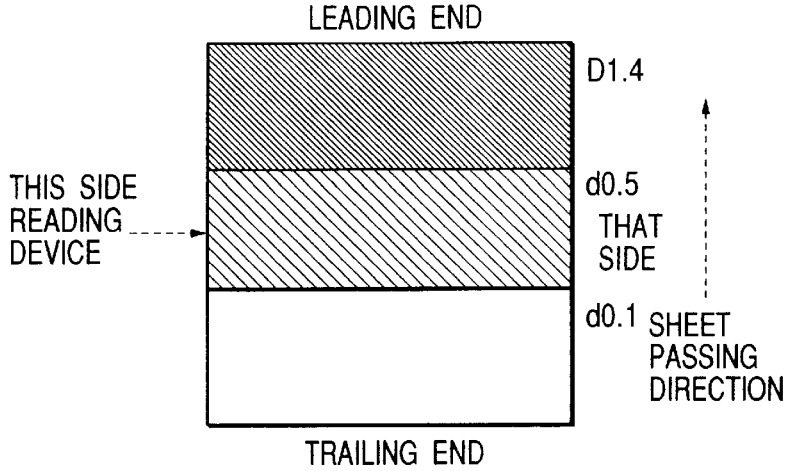
FIGS. 13A, 13B and 13C are views for explaining uneven density correction.

Step 4: The image forming apparatus outputs a test image sample as shown in FIG. 13A. As conditions for forming the sample, in order to form a complete black copy, a halftone copy and a blank copy, the image exposure condition obtained by the primary charging condition for forming the surface potential as mentioned above is effected in accordance with the three kinds (8-bit signal; F0 hex, 80 hex, 00 hex in FIG. 11), and the developing, transferring and fixing are effected under the above-mentioned developing condition, thereby outputting the sample.

Step 5: The output sample is rested on the original glass stand by the user in such a manner that a leading end of the sample in a sample sheet passing direction and this side or that side of the sample are positioned at predetermined positions, and, by using original recognizing means, it is judged whether the completion of the resting is detected or not.

Step 6: If the completion of the resting is judged, the original is read by the reader. It is desirable that the reading of the reader is effected with resolving power of about 400 to 600 dpi.

Step 7: It is judged whether the original is the test image sample or not on the basis of judgement whether density gradation is the mane pattern or not. If it is judged as no test image sample, in a step 11, informing of error is effected and the mode is ended.

Incidentally, in this case, the program may be returned to the step 5.

Figure 13B:
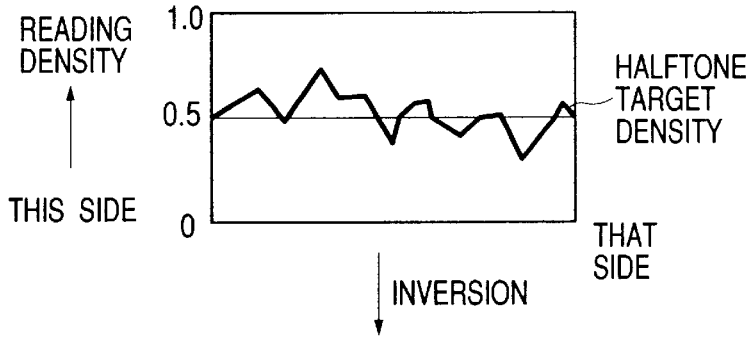

Step 8: If it is judged as the test image sample, axial density distribution is calculated as shown in FIG. 13B. When the test image sample is formed with F0 hex, 80 hex and 00 hex of PWM level, read density distribution in the halftone portion (80 hex) in which the unevenness can be detected most easily is calculated (Each density distribution in F0 hex, 80 hex and 00 hex may be calculated).

Figure 13C:
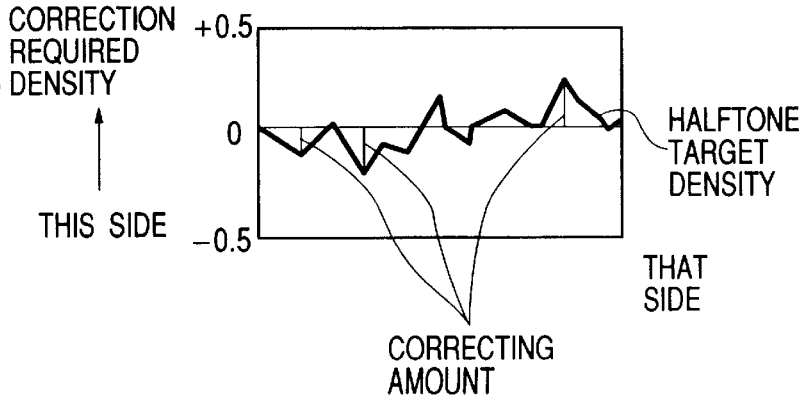

Step 9: When target density is selected to 0.5 in FIG. 13B, increase or decrease in the read density distribution of the halftone portion with respect to 0.5 is calculated to correspond to each pixel in the main scanning direction. When minus correction is indicated as "−" and plus correction is indicated as "+", the required correction density is shown as a correction required density view as illustrated in FIG. 13C which has inverse polarity of FIG. 13B.

Step 10: From the correction required density view, correction light amount (correction level) per pixel of the dot exposing laser is sought from FIG. 14. As an example, if the required correction density is +0.8 in FIG. 14, correction of surface potential of −200 V, correction of drum surface light amount of +0.25 $\mu$J and correction of image data of +80 hex will be required. The correcting amount level corresponding to each pixel in the main scanning direction is allocated by such capacity to form a correcting table. Then, this mode is finished, and the operation panel (input interface) of the image forming apparatus is returned to the normal copy or print mode.

When the correction corresponding to each pixel position in the main scanning direction is determined in this way, such correction data is stored in a correcting table in an uneven main scan correcting circuit 50 (FIG. 1).

Figure 20:
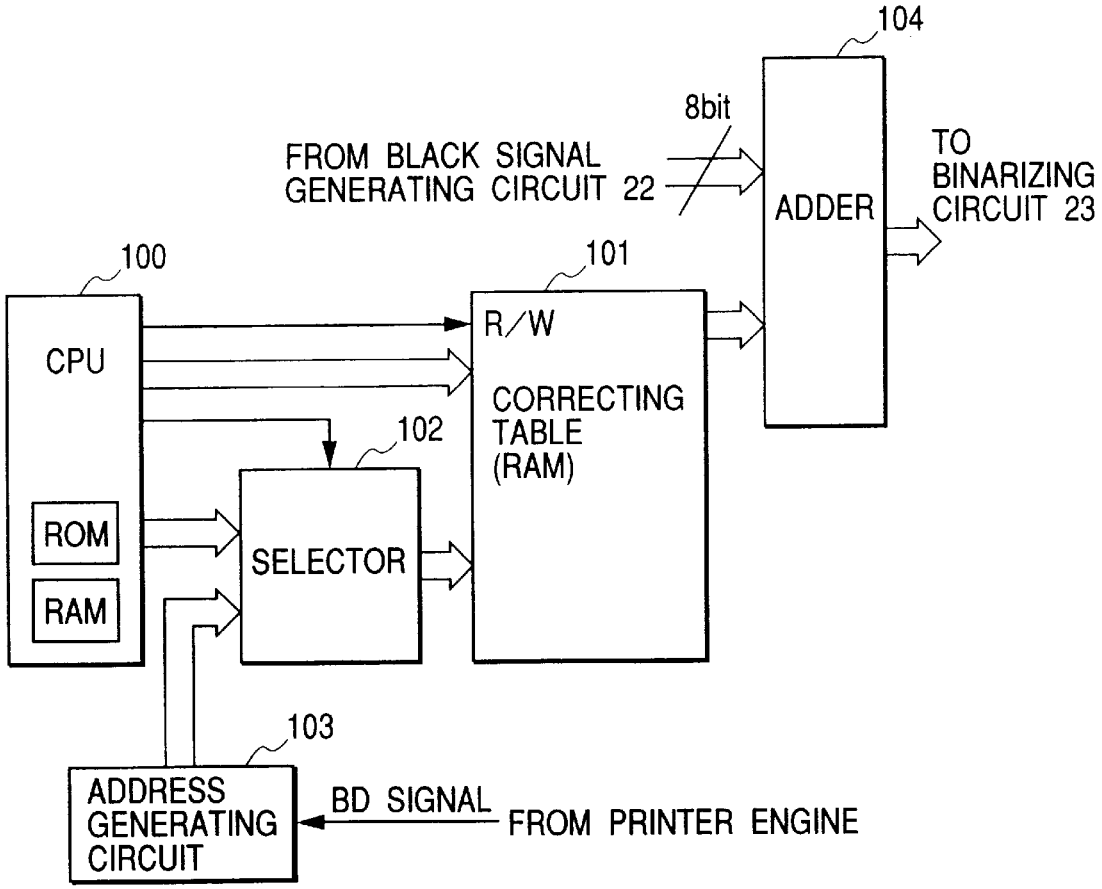
FIG. 20 is a block diagram of an uneven density correcting circuit.

FIG. 20 shows a concrete circuitry of the uneven main scan correcting circuit 50 according to the illustrated embodiment.

As shown, the uneven main scan correcting circuit 50 comprises a correcting table 101, an adder 104, a selector 102 and an address generating circuit 103. A CPU 100 serves to control the entire main body of the image forming apparatus and includes a ROM for storing control program for the copying machine and the program associated with the flow chart explained in connection with FIG. 12, and a RAM used as a work area.

In an arrangement as shown, the correcting table 101 has a capacity for at least the number of pixels in the main scanning direction (9 bit per pixel; among them, 1 bit is plus/minus sign bit). As already mentioned, the correction data for each pixel formed on the basis of the image data obtained by reading the test image sample is written in corresponding address position of the correcting table 101 (constituted by RAM). To this end, the CPU 100 outputs a signal (for causing address from the CPU 100 to be supplied to the correcting table 101) to the selector 102 and outputs the address, data to be written and a writing signal to the correcting table 101. When the writing of the correcting data for positions of all pixels in the main scanning direction is finished in this way, a signal for causing the selector 102 to select the address from the address generating circuit 103 is outputted and a reading signal is outputted.

The address generating circuit 103 utilizes a beam detect signal near the photosensitive drum 1 as trigger and serves to successively output the address signals to the correcting table 101 in synchronous with conveying clock for the image data from the black signal generating circuit 22 at a predetermined timing. As a result, the correcting table 101 outputs a correcting signal in synchronous with the image data (pixel data) from the black signal generating circuit 22. The adder 104 serve to add the data from the correcting table 101 to the image data from the black signal generating circuit 22 and output the result to the binarizing circuit 23. As mentioned above, since the plus and minus correcting data are stored in the correcting table 101, in the adder 104, image data obtained by correcting the property of the image data in accordance with the property of the printer engine to the binarizing circuit 23.

By the way, the formation of the test image sample is effected by outputting 00 hex, 80 hex and F0 hex data, every the predetermined number of main scan lines from the CPU 100, in place of the black signal generating circuit 22. However, since the test image for seeking the property of the printer engine is formed, no data or 0 (zero) data is outputted from the correcting table 101. As the case may be, when the test image sample is formed, 00 hex, 80 hex and F0 hex data may be written in the correcting table 101 at an appropriate timing and such data may be outputted. In this case, if the image reading is not effected, since 0 data is outputted from the black signal generating circuit 22, ultimately, the above-mentioned test image sample can be formed. The merit in this case is that the test image sample can be formed only by the mechanism shown in FIG. 21.

Since data correction such as image unevenness is effected with 8-bit multi value signal steps by using the above-mentioned correcting table, upon binarization, the data having no unevenness has been formed, and, upon laser writing, the density unevenness has been corrected completely, so that a high quality image having no density unevenness in longitudinal direction (main scanning direction) can always be provided. Particularly, in accordance with the illustrated embodiment, the density unevenness in a relatively low density portion (highlight portion) can be suppressed.

Incidentally, when applied to an apparatus for forming an image with PWM system, the output of the adder 104 may be A/D-converted, and a signal having a pulse width depending upon density as shown in FIG. 4 may be formed by comparing the converted data with a triangular wave from a triangular wave generating circuit, and such a signal may be supplied to the laser driving circuit 24. The reason why the pulse width signal can be formed even zero (0) density is as mentioned above. Incidentally, the laser driving circuit 24 is operated to generate the laser beam for a time period depending upon the pulse width of the PWM signal.

As mentioned above, when the fixing thermistor temperature upon ON of the main switch is the predetermined temperature or lower and the environment is in the predetermined water vapor amount range (or larger), it is judged as First Early in the Morning and high humidity environment (or corresponding environment), and the Idle Rotation of the drum (and Idle Rotations of the developing device and the cleaner system) is effected in accordance with such water vapor amount, and, substantially at the same time, the primary charging, laser exposure and development are effected on the photosensitive drum to form the toner black belt thereby to combine thereto, and the uneven density is corrected in the laser writing level by using the correcting table. In this way, the developing ability is increased to provide adequate density and maintain the adequate individual dot reproducing ability. As a result, in a copy image obtained in the condition of the First Early in the Morning under the high humidity environment, there is no smeared image, thereby obtaining a uniform high quality image with high density.

Second Embodiment

Next, a second embodiment of the present invention will be explained with reference to the accompanying drawings.

Figure 15:
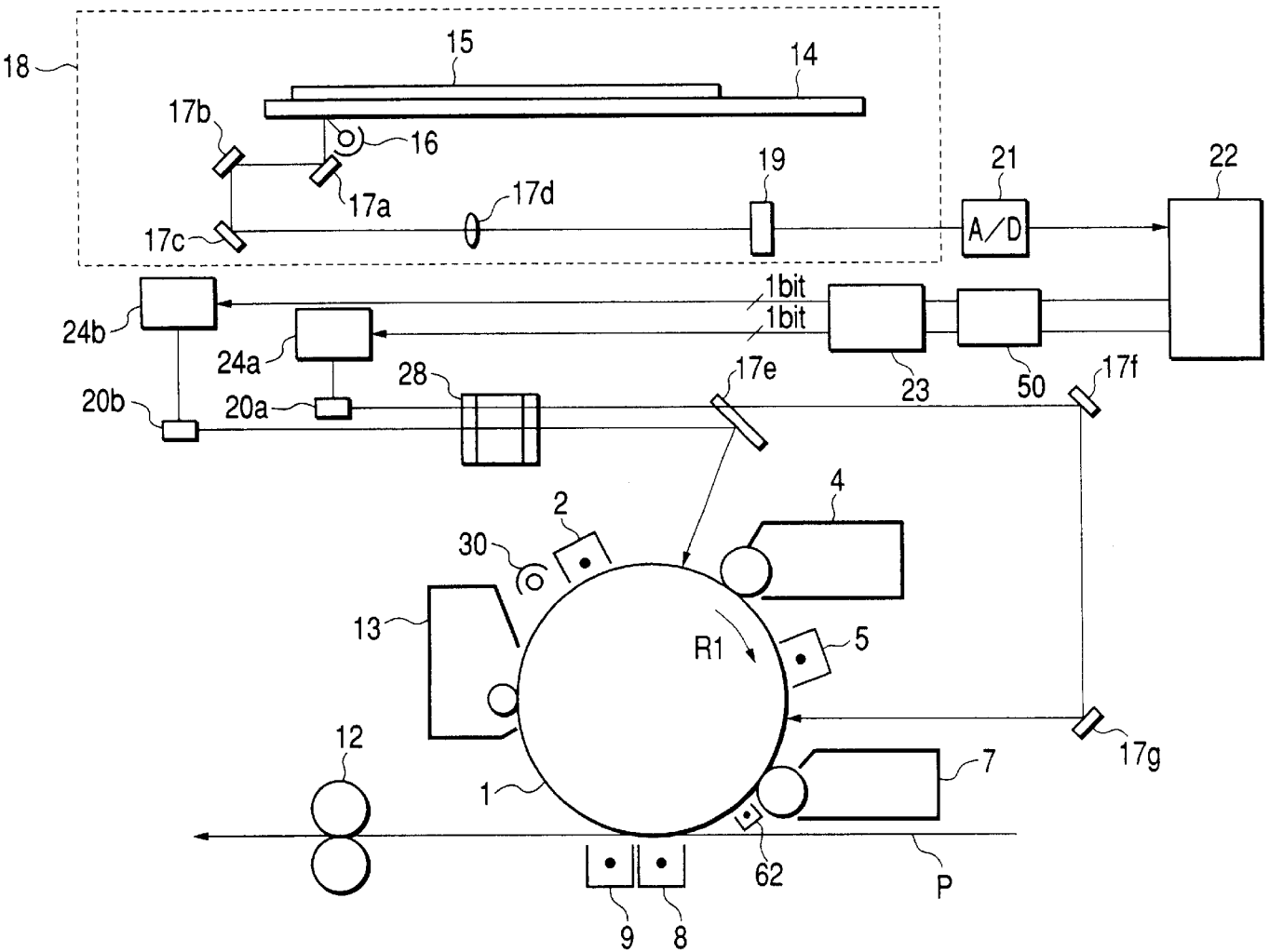
FIG. 15 is a schematic constructural view of an image forming apparatus according to a second embodiment of the present invention.

FIG. 15 is a schematic constructural view of an image forming apparatus according to a second embodiment of the present invention.

A photosensitive drum 1 as an electrophotographic photosensitive member is constituted by coating a photoconductive layer on a cylindrical conductive substrate and is supported for rotation in a direction shown by the arrow R1. Around the photosensitive drum 1, there are disposed, in order along a rotational direction thereof, a first scorotron charger 2 for uniformly charging a surface of the photosensitive drum 1, a first exposure device for reading an original and for forming a first electrostatic latent image by exposing the photosensitive drum 1 on the basis of a first image signal proportional to density of one of color images decomposed into two colors, a first developing device 4 for forming a first toner image by adhering toner to the electrostatic latent image, a second scorotron charger (referred to as "recharger" hereinafter) 5 for charging the photosensitive drum 1 bearing the first toner image, a second exposure device for effecting exposure with exposure amount obtained by adding a certain exposure amount to exposure amount based on a second image signal proportional to density of the other of the color decomposed images, thereby forming a second electrostatic latent image, a second developing device 7 for forming a second toner image by adhering toner to the second electrostatic latent image, a transfer pre-charger 62 for charging the superimposed color images formed on the photosensitive drum 1 before transferring, a corona transfer charger (transfer charger) 8 for transferring the superimposed color images onto a transfer sheet (transfer material) P, an electrostatic separating charger (separating charger) 9 for separating the transfer sheet P to which the superimposed color images were transferred from the photosensitive drum 1, a cleaning device 13 for removing residual toner from the photosensitive drum 1 after the superimposed color images were transferred, and a pre-exposure (lamp) 30 for eliminating residual charge on the photosensitive drum 1. Further, after separated from the photosensitive drum 1, the transfer sheet P to which the superimposed color images were transferred is conveyed to a fixing device 12, where the toner images are fixed to the transfer sheet, and the transfer sheet P to which the toner images were fixed is discharged out of a main body of the image forming apparatus.

Further, in an image scanner portion 18, an original 15 rested on an original glass stand 14 is scanned and read by an illumination lamp 16, and image information is converted into an electric signal by a photo-electric converting element 19. The light reflected from the original 15 scanned by the illumination lamp 16 is imaged on the photo-electric converting element 19 including red, green and blue filters therein through mirrors 17*a*, 17*b*, 17*c* and a lens 17*d*. The red, green and blue electric signals outputted from the photo-electric converting element 19 are A/D-converted by an A/D-converter 21 into digital image data which are in turn sent to a signal processing portion (color decomposing portion) 22 to form image signals proportional to image densities of red and black color components.

Figure 17:
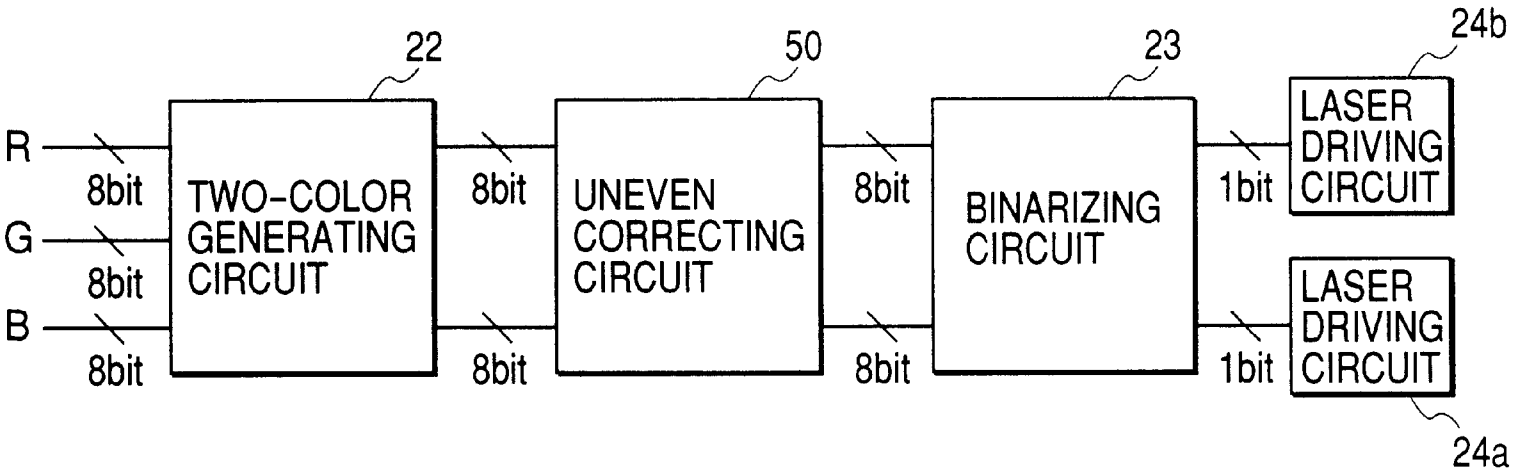
FIG. 17 is a block diagram showing a light source driving circuit.

Here, the image data per pixel is corrected by an axial (main scanning direction) unevenness correcting table 50 (FIG. 17).

The red image signal (first image signal) and black image signal (second image signal) are sent to laser drivers (signal generating portions) 24*b*, 24*a*, where the lightening of lasers 20*b*, 20*a* are turned ON/OFF in accordance with the red and black image signals. The laser beam (first image information) emitted in response to the red image signal serves to write the first electrostatic latent image on the photosensitive drum 1 through a polygon mirror 28 and a mirror 17*e*. The laser beam (second image information) emitted in response to the black image signal serves to write the second electrostatic latent image on the photosensitive drum 1 through the polygon mirror 28 and mirrors 17*f*, 17*g*.

In the illustrated embodiment, an amorphous silicon drum is used as the photosensitive drum 1. The amorphous silicon drum has advantages that it has high endurance and long service life.

FIGS. 16A to 16F are views for explaining an image forming process in a two-color image forming mode according to the illustrated embodiment, and FIGS. 16A to 16F show various steps and each shows a relationship between surface potential of the photosensitive member and developing bias.

Figure 16A:
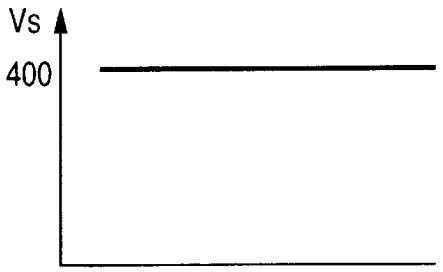
FIGS. 16A, 16B, 16C, 16D, 16E and 16F are views showing surface potential of a photosensitive drum in image formation.
Figure 16D:
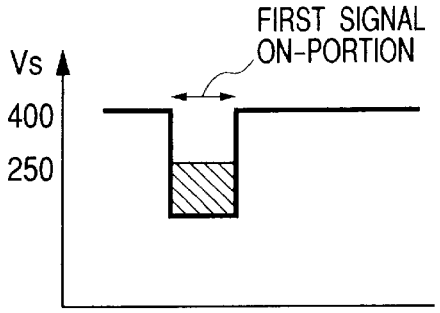
Figure 16B:
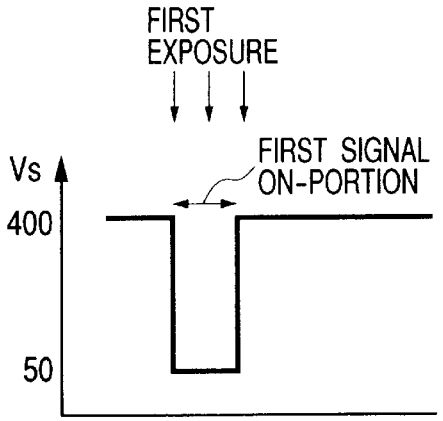

In FIG. 16A, the photosensitive drum 1 is uniformly charged with +420 V, for example, by the second scorotron charger 2. Then, in FIG. 16B, the first exposure of the image information is effected so that the surface potential $V_S$ of the exposed portion is decreased to +50 V, for example, thereby forming the first electrostatic latent image. Then, in FIG. 16C, by applying developing bias voltage (for example, +300 V shown by the broken line) to a sleeve of the first developing device 4, the exposure portion is reverse-developed. After the first development, re-charging is effected in FIG. 16D. In this case, voltage of 600 V greater than desired second developing position potential of 400 V is applied to a grid to charge the first developing non-imaged portion to 600 V, for example. In this case, the first developing portion is charged to 500 V, for example.

Figure 16E:
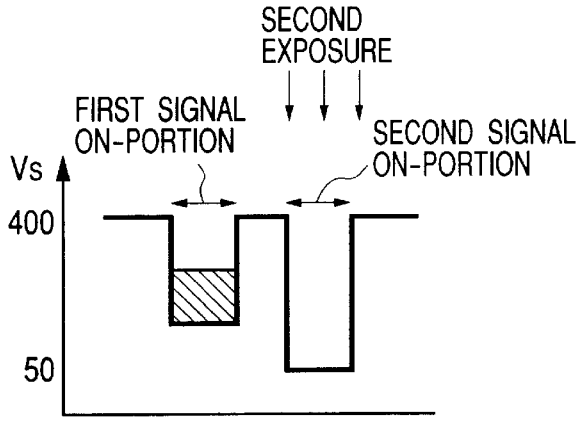
Figure 16C:
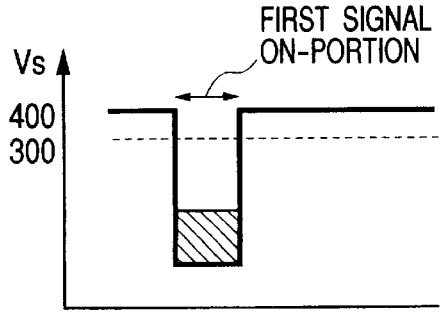
Figure 16F:
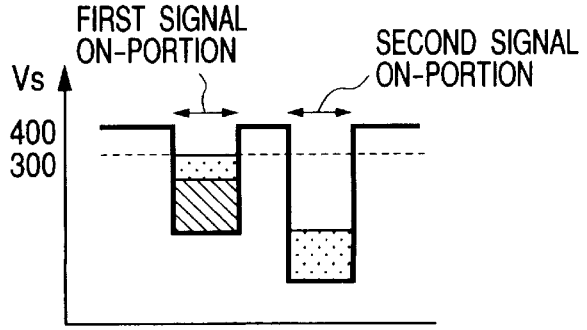
Figure 16F:
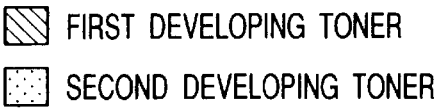

Then, in FIG. 16E, when the exposure in accordance with the second image information is effected, exposure having an exposure amount greater than the exposure amount in the second single color development by certain constant exposure amount (for example, exposure amount for decreasing the first developing non-imaged portion by 200 V) is effected. In this case, when the certain constant exposure amount is used, in the first developing portion, the potential at the first developing non-imaged portion is merely reduced slightly (for example, reduced only by 100 v). the reason is that the light cannot be passed through the first developer but is scattered. It was found that permeability is 50%. After the first developing non-imaged portion is re-charged so that the surface potential $V_S$ after exposure with second exposure constant exposure amount of 0.25 $\mu$J becomes second developing position target potential of 400 V, the target potential was selected to 600 V in supposing linearity of known drum sensitivity of 800 v/$\mu$J. Based on permeability of 50% of known toner layer, the light amount reached to the first developing imaged portion on the drum becomes 0.125 $\mu$J. Similar to the above-mentioned method, the target potential after first developing imaged portion is re-charged may be set to 500 V.

In the illustrated embodiment, although a laser diode is used as the second exposure means, complicated processes are not required in the second developing single color mode and two color mode. Since the light amount of the laser is determined by laser driving electric current, in the two color mode, constant offset current is added to the driving electric current for the second developing single color mode. That is to say, the second image signal OFF portion is also subjected to weak exposure, and the ON portion is also subjected to exposure with exposure amount obtained by adding exposure amount corresponding to the weak exposure to the normal exposure amount, so that the potential of the first developing imaged portion becomes 400 V and the potential of the first developing non-imaged portion also becomes 400 V, and, when the second image signal is ON, the first developing non-imaged portion is exposed to 50 V. Thereafter, in the developing process, by applying bias of 300 V to a second development sleeve, adequate second image density can be obtained while preventing the second developer from mixing with the first developer and from being developed on the second developing non-imaged portion.

Hereinbelow, a smeared image preventing sequence utilizing high humidity environment detection which is one of characteristics of the present invention is shown. Operation is the same as that in the first embodiment.

EXAMPLE 1

HH First Early in the Morning Idle Rotation+Toner Black Belt

Purpose: Flow Substance Removal (Scraping) for Countermeasure to a Smeared Image Summary: When a fixing thermistor temperature upon ON of a main switch is a predetermined temperature or lower and an environment is a predetermined water vapor amount or larger, it is judged as First Early in the Morning and high humidity environment, and the Idle Rotation of the drum (and Idle Rotations of the developing device and cleaner system) is started and substantially at the same time as the Idle Rotation, primary-charging, laser exposure and development are effected on the drum, thereby forming a toner black belt.

Conditions (1) First Early in the Morning judgement: the fixing thermistor temperature upon switched-ON of the main switch is 120° C. or lower (2) HH (high temperature and high humidity) judgement: the water vapor amount is 16 g or larger (3) Idle Rotation time: From immediately after the First Early in the Morning HH judgement to the fixing thermistor temperature of 195° C., the Idle Rotation is effected for about 4.5 minutes (The rotation time is varied with fixing thermistor temperature upon initiation of the Idle Rotation).

(4) Primary charge: Output having a control value in yesterday (if no data, default output). The output time is a time corresponding to a width of the black belt.

(5) Laser: Output having a power control value in yesterday. Solid output of image area with FF hex. The output time is a time corresponding to the width of the black belt.

(6) Development: Output having a DC control value in yesterday. AC+DC (if no data, default output). The output time is a time corresponding to a width of the black belt. DC value can be inputted. Black belt density is variable.

(7) Black belt width: 100 mm on the surface of the drum (50, 200 or 400 mm can selectively be inputted. Further, voluntary input is permitted for variable width).

(In the tests, it was ascertained that, regarding the black belt width of about 84 mm, the smeared image is eliminated by effecting the Idle Rotation for three minutes.)

As mentioned above, regarding the smeared image, even in the most severe high humidity environment (having water vapor amount of 9 g/m$^3$), the good image can be obtained from immediately after the starting of the image forming apparatus regardless of the environment.

Hereinbelow, a method for correcting unevenness in the main scanning direction caused when uneven density in the developing device or other uneven density is generated will be fully described.

Similar to the first embodiment, explanation will be made with reference to the flowchart for the correcting operation shown in FIG. 12.

(1) The image forming apparatus according to the illustrated embodiment has an "Improving Image Mode" for improving the image unevenness at its input interface. First of all, such a mode is started.

(2) Then, an axial unevenness (unevenness in the main scanning direction) correcting mode is selected.

(3) A key for starting the axial unevenness correcting mode is depressed to start such a mode.

(4) The image forming apparatus outputs a test image sample as shown in FIG. 13A. As conditions for forming the sample, in order to form a complete black copy, a halftone copy and a blank copy, the image exposure condition obtained by the primary charging condition for forming the surface potential as mentioned above is effected in accordance with the three kinds (F0 hex, 80 hex, 00 Hex of PWM level in FIG. 11), and the developing, transferring and fixing are effected under the above-mentioned developing condition, thereby outputting the sample.

According to the characteristic of the second embodiment, the test sample images for two colors (for example, red and black) are outputted.

Thereafter, the following steps (5) to (10) are effected for respective colors (red and black).

(5) The output sample is rested on the original glass stand by the user in such a manner that a leading end of the sample in a sample sheet passing direction and this side or that side of the sample are positioned at predetermined positions, and, by using original recognizing means, it is judged whether the completion of the resting is detected or not.

(6) If the completion of the resting is judged, the original is read by the reader as mentioned above. It is desirable that the reading of the reader is effected with resolving power of about 400 to 600 dpi.

(7) It is judged whether the original is the test image sample or not on the basis of judgement whether density gradation is the mane pattern or not.

(8) If it is judged as the test image sample, axial density distribution is calculated as shown in FIG. 13B. When the test image sample is formed with F0 hex, 80 hex and 00 hex of PWM level, read density distribution in the halftone portion (80 hex) in which the unevenness can be detected most easily is calculated (Each density distribution in F0 hex, 80 hex and 00 hex may be calculated).

(9) When target density is selected to 0.5 in FIG. 13B, increase or decrease in the read density distribution of the halftone portion with respect to 0.5 is calculated to correspond to each pixel in the main scanning direction. When minus correction is indicated as "−" and plus correction is indicated as "+", the required correction density is shown as a correction required density view as illustrated in FIG. 13C which has inverse polarity of FIG. 13B.

Figure 14:
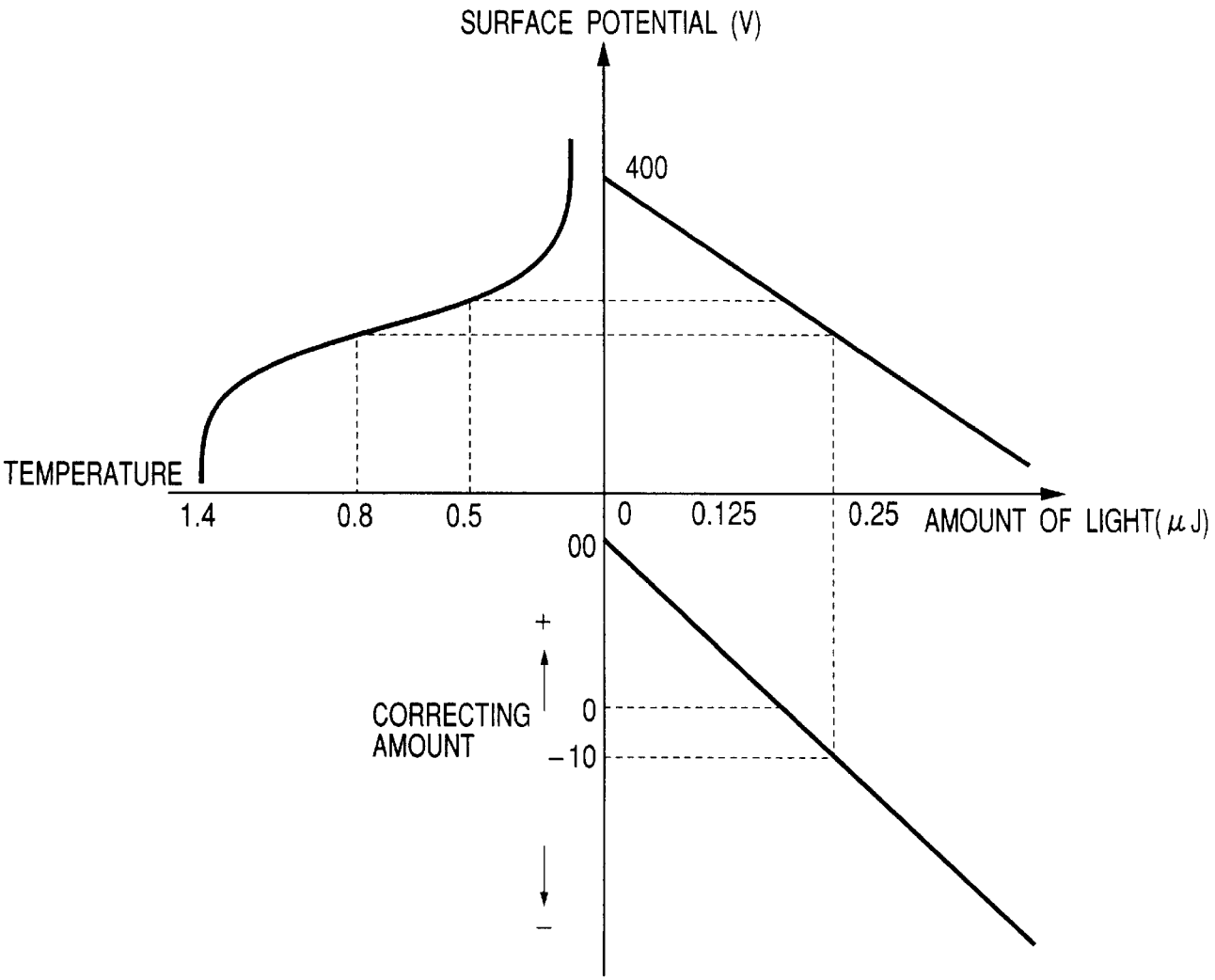
FIG. 14 is a view for explaining uneven density correction.

(10) From the correction required density view, correction light amount (correction level) per pixel of the dot exposing laser is sought from FIG. 14. As an example, if the required correction density is +0.8 in FIG. 14, correction of surface potential of −200 V, correction of drum surface light amount of +0.25 $\mu$J and correction of image data of +80 hex will be required. The correcting amount level corresponding to each pixel in the main scanning direction is allocated by such capacity to form a correcting table. Then, this mode is finished, and the operation panel (input interface) of the image forming apparatus is returned to the normal copy or print mode.

As mentioned above, when the fixing thermistor temperature upon switched-ON of the main switch is the predetermined temperature or lower and the environment is in the predetermined water vapor amount range (or larger), it is judged as First Early in the Morning and high humidity environment (or corresponding environment), and the Idle Rotation of the drum (and Idle Rotations of the developing device and the cleaner system) is effected in accordance with such water vapor amount, and, substantially at the same time as the initiation of the Idle Rotation, the primary charging, laser exposure and development are effected on the photosensitive drum to form the toner black belt thereby to combine thereto, and the uneven density is corrected in the laser writing level by using the correcting table. In this way, the developing ability is increased to provide adequate density and maintain the adequate individual dot reproducing ability. As a result, in a copy image obtained in the condition of the First Early in the Morning under the high humidity environment, there is no smeared image, thereby obtaining a uniform high quality image with high density.

Third Embodiment

Next, a third embodiment of the present invention will be explained.

Figure 18:
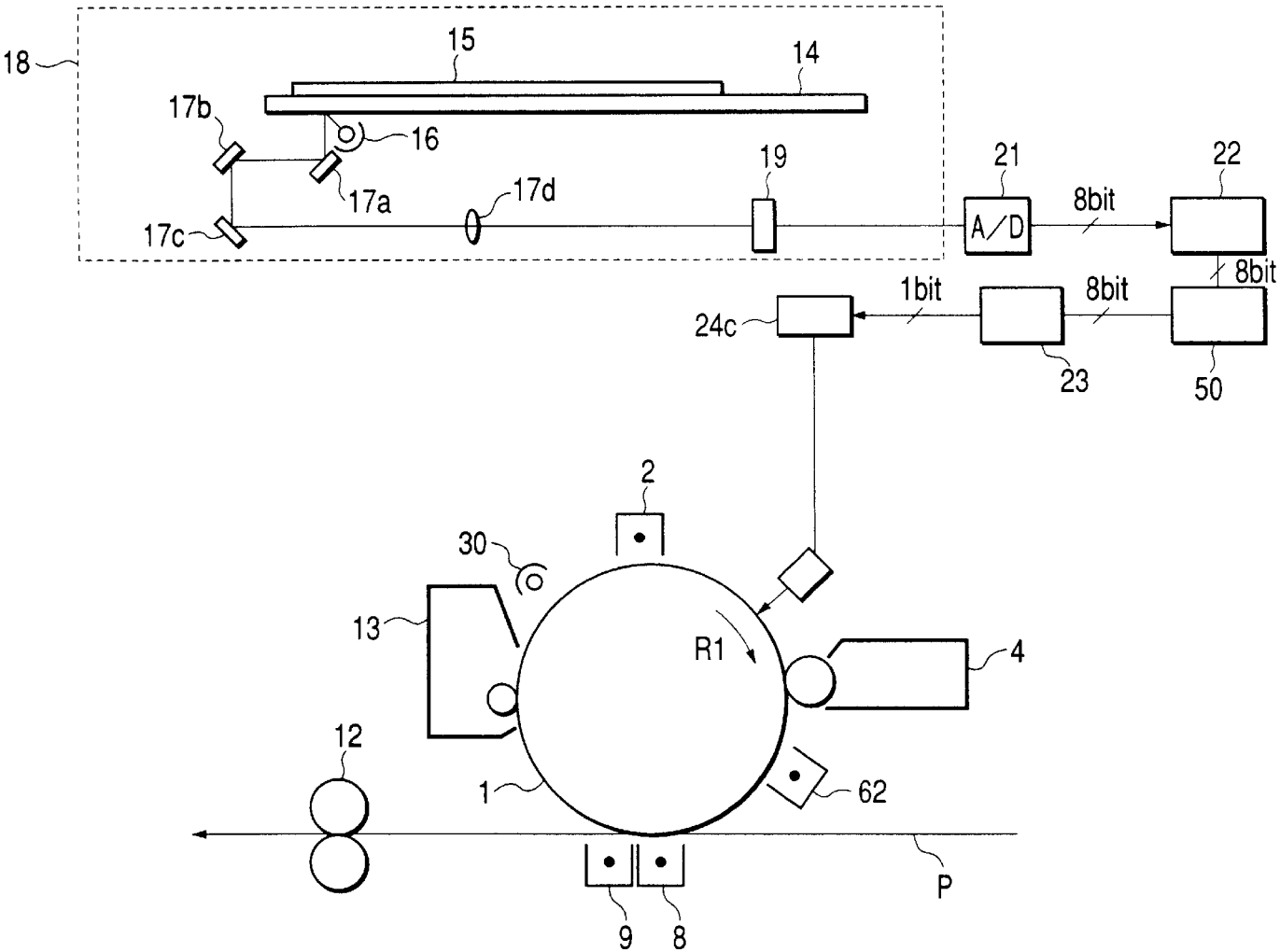
FIG. 18 is a schematic constructural view of an image forming apparatus according to a third embodiment of the present invention.

FIG. 18 is a schematic constructural view of an image forming apparatus according to a third embodiment of the present invention.

A photosensitive drum 1 as a photosensitive member is constituted by coating a photoconductive layer on a cylindrical conductive substrate and is supported for rotation in a direction shown by the arrow R1. Around the photosensitive drum 1, there are disposed, in order along a rotational direction thereof, a scorotron charger 2 for uniformly charging a surface of the photosensitive drum 1, an exposure device for reading an original and for forming an electrostatic latent image by exposing the photosensitive drum 1 in accordance with an image signal proportional to image density, a developing device 4 for forming a toner image by adhering toner to the electrostatic latent image, a transfer pre-charger 62 for charging the toner image prior to the transferring, a corona transfer charger (transfer charger) 8 for transferring the toner image formed on the photosensitive drum 1 onto a transfer sheet (transfer material) P, an electrostatic separating charger (separating charger) 9 for separating the transfer sheet P on which the toner image is transferred from the photosensitive drum 1, a cleaning device 13 for removing residual toner from the photosensitive drum 1 after the toner image transferring, and a pre-exposure (lamp) 30 for eliminating residual charge on the photosensitive drum 1. After separated from the photosensitive drum 1, the transfer sheet P to which the toner image was transferred is conveyed to a fixing device 12, where the toner image is fixed to the transfer sheet, and the transfer sheet P to which the toner image was fixed is discharged out of a main body of the image forming apparatus.

In a reader portion 18, an original 15 rested on an original glass stand 14 is illuminated by an illumination lamp 16, and light reflected from the original is focused on a photoelectric converting element (one-line CCD) 19 to convert the light into an electrical signal corresponding to image information. The light reflected from the original 15 illuminated by the illumination lamp 16 is imaged on the photo-electric converting element 19 through mirrors 17*a*, 17*b*, 17*c* and a lens 17*d*. The electrical signal outputted from the photoelectric converting element 19 is A/D-converted by an A/D-converter 21 into an 8-bit digital image data which is in turn logarithmically transformed in a black signal generating circuit 22 for changing luminance information to density information to obtain image density data.

Here, the image data per pixel in the main scanning direction is corrected by a main scanning direction unevenness correcting table 50. A correcting method in the main scanning direction unevenness correcting table 50 will be described later.

The 8-bit digital image data signal formed in this way is inputted to an LED driving circuit 24 which is one of characteristics of the present invention. The LED driving circuit 24 is a well-known PWM circuit which serves to modulate a time for turning ON/OFF a laser diode in accordance with the magnitude of the inputted image density signal. LED light driven and emitted in response to the image signal is written on the photosensitive drum 1, thereby forming a digital electrostatic latent image as image information.

In the illustrated embodiment, an amorphous silicon (a-Si) drum is used as the photosensitive drum 1. The amorphous silicon drum has advantages that it has high endurance and long service life.

Steps for explaining an image forming process according to this embodiment are the same as those in the first embodiment.

Hereinbelow, a smeared image preventing sequence utilizing high humidity environment detection which is one of characteristics of the present invention is shown. Conditions of the sequence for each purpose are as follows:

EXAMPLE 1

HH First Early in the Morning Idle Rotation+Toner Black Belt

Purpose: Flow Substance Removal (Scraping) for Countermeasure to a Smeared Image Summary: When a fixing thermistor temperature upon switched-ON of a main switch is a predetermined temperature or lower and an environment is a predetermined water vapor amount or larger, it is judged as First Early in the Morning and high humidity environment, and the Idle Rotation of the drum (Idle Rotations of the developing device and cleaner system) is started and substantially at the same time as the Idle Rotation, primary-charging, laser exposure and development are effected on the drum, thereby forming a toner black belt.

Conditions (1) First Early in the Morning judgement: the fixing thermistor temperature upon switched-ON of the main switch is 120° C. or lower (2) HH (high temperature and high humidity) judgement: the water vapor amount is 16 g or larger (3) Idle Rotation time: From immediately after the First Early in the Morning HH judgement to the fixing thermistor temperature of 195° C., the Idle Rotation is effected for about 4.5 minutes (The rotation time is varied with fixing thermistor temperature upon initiation of the Idle Rotation).

(4) Primary charge: Output having a control value in yesterday (if no data, default output). The output time is a time corresponding to a width of the black belt.

(5) Laser: Output having a power control value in yesterday. Solid output of image area with FF hex. The output time is a time corresponding to the width of the black belt.

(6) Development: Output having a DC control value in yesterday. AC+DC (if no data, default output). The output time is a time corresponding to a width of the black belt. DC value can be inputted. Black belt density is variable.

(7) Black belt width: 100 mm on the surface of the drum (50, 200 or 400 mm can selectively be inputted. Further, voluntary input is permitted for variable width).

(In the tests, it was ascertained that, regarding the black belt width of about 84 mm, the smeared image is eliminated by effecting the Idle Rotation for three minutes.)

EXAMPLE 2

HH, JJ (Normal Temperature & Normal Humidity), NL (Normal Temperature & Low Humidity) First Early in the Morning Toner Black Belt+Idle Rotation and its Variations Purpose: Maintaining of Density Upon Disposal Under High Humidity and Smeared Image Prevention Summary: When a fixing thermistor temperature upon switched-ON of a main switch is a predetermined temperature or lower and an environment is in a predetermined water vapor amount range (or larger), it is judged as First Early in the Morning and high humidity environment (and each environment), and the Idle Rotation of the drum (developing device and a cleaner system) is started in accordance with such water vapor amount and substantially at the same time as initiation of the Idle Rotation, primary-charging, laser exposure and development are effected on the drum, thereby combining with the formation of a Toner Black Belt.

(a) First Early in the Morning Black Belt+Idle Rotation: Water vapor amount W≧9 g (b) First Early in the Morning Idle Rotation: Water vapor amount 9 g>W≧5 g (c) Normal Pre-Multi Rotation Only: Water vapor amount less than 5 g Conditions (1) First Early in the Morning Judgement: the fixing thermistor temperature upon switched-ON of the main switch is 100° C. or lower (2) HH Judgement:

(a) First Early in the Morning Black Belt+Idle Rotation: Water vapor amount W≧9 g (b) First Early in the Morning Idle Rotation: Water vapor amount 9 g>W≧5 g (c) Normal Pre-Multi Rotation Only: Water vapor amount less than 5 g (3) Idle Rotation time: From immediately after the First Early in the Morning HH judgement to the fixing thermistor temperature of 195° C., the Idle Rotation is effected for about 4.5 minutes (The rotation time is varied with fixing thermistor temperature upon initiation of the Idle Rotation).

(4) Primary charge: Output having a control value in yesterday (if no data, default output). The output time is a time corresponding to a width of the black belt.

(5) Laser: Output having a powder control value in yesterday. Solid output of image area with FF hex. The output time is a time corresponding to the width of the black belt.

(6) Development: Output having a DC control value in yesterday. AC+DC (if no data, default output). The output time is a time corresponding to a width of the black belt. DC value can be inputted. Black belt density is variable.

(7) Black belt:

Sub-scanning direction length: 400 mm on the surface of the drum.

Input is permitted.

Main scanning direction length: Denomination width of A3 width parted down in the center of image area (not including lateral registration tolerance) Timing: Substantially the same as initiation of Idle Rotation With TOner Black Belt+Idle Rotation, the density under JJ First Early in the Morning is improved from 1.2 to 1.32. (It was ascertained that, regarding the black belt width of about 84 mm, the smeared image is eliminated by effecting the Idle Rotation for three minutes.)

As mentioned above, regarding the smeared image, even in the most severe high humidity environment (having water vapor amount of 9 g/m$^3$), the good image can be obtained from immediately after the starting of the image forming apparatus regardless of the environment.

Hereinbelow, a method for correcting unevenness in the main scanning direction caused when uneven density in the developing device or other uneven density is generated will be fully described.

Similar to the first embodiment, explanation will be made with reference to the flowchart for the correcting operation shown in FIG. 12.

(1) The image forming apparatus according to the illustrated embodiment has an "Improving Image Mode" for improving the image unevenness at its input interface. First of all, such a mode is started.

(2) Then, an axial unevenness (unevenness in the main scanning direction) correcting mode is selected.

(3) A key for starting the axial unevenness correcting mode is depressed to start such a mode.

(4) The image forming apparatus outputs a test image sample as shown in FIG. 13A. As conditions for forming the sample, in order to form a complete black copy, a halftone copy and a blank copy, the image exposure condition obtained by the primary charging condition for forming the surface potential as mentioned above is effected in accordance with the three kinds (F0 hex, 80 hex, 00 Hex of PWM level in FIG. 11), and the developing, transferring and fixing are effected under the above-mentioned developing condition, thereby outputting the sample.

(5) The output sample is rested on the original glass stand by the user in such a manner that a leading end of the sample in a sample sheet passing direction and this side or that side of the sample are positioned at predetermined positions, and, by using original recognizing means, it is judged whether the completion of the resting is detected or not.

(6) If the completion of the resting is judged, the original is read by the reader as mentioned above. It is desirable that the reading of the reader is effected with resolving power of about 400 to 600 dpi.

(7) It is judged whether the original is the test image sample or not on the basis of judgement whether density gradation is the same pattern or not. (8) If it is judged as the test image sample, axial density distribution is calculated as shown in FIG. 13B. When the test image sample is formed with F0 hex, 80 hex and 00 hex of PWM level, read density distribution in the halftone portion (80 hex) in which the unevenness can be detected most easily is calculated (Each density distribution in F0 hex, 80 hex and 00 hex may be calculated).

(9) When target density is selected to 0.5 in FIG. 13B, increase or decrease in the read density distribution of the halftone portion with respect to 0.5 is calculated to correspond to each pixel in the main scanning direction. When minus correction is indicated as "−" and plus correction is indicated as "+", the required correction density is shown as a correction required density view as illustrated in FIG. 13C which has inverse polarity of FIG. 13B.

(10) From the correction required density view, correction light amount (correction level) per pixel of the dot exposing laser is sought from FIG. 14. As an example, if the required correction density is +0.8 in FIG. 14, correction of surface potential of −200 V, correction of drum surface light amount of +0.25 μJ and correction of image data of +80 hex will be required. The correcting amount level corresponding to each pixel in the main scanning direction is allocated by such capacity to form a correcting table. Then, this mode is finished, and the operation panel (input interface) of the image forming apparatus is returned to the normal copy or print mode.

As mentioned above, when the fixing thermistor temperature upon switched-ON of the main switch is the predetermined temperature or lower and the environment is in the predetermined water vapor amount range (or larger), it is judged as First Early in the Morning and high humidity environment (or corresponding environment), and the Idle Rotation of the drum (and Idle Rotations of the developing device and the cleaner system) is effected in accordance with the water vapor amount range, and, substantially at the same time as the initiation of the Idle Rotation, the primary charging, laser exposure and development are effected on the photosensitive drum to form the toner black belt thereby to combine thereto, and the uneven density is corrected in the LED writing level by using the correcting table. In this way, the developing ability is increased to provide adequate density and maintain the adequate individual dot reproducing ability. As a result, in a copy image obtained in the condition of the First Early in the Morning under the high humidity environment, there is no smeared image in the longitudinal direction (main scanning direction), thereby obtaining a uniform high quality image with high density by a compact image forming apparatus.

Incidentally, in the above-mentioned first to third embodiments, while an example that the image is formed by the binarizing process using the error diffusion method (or dither method) was explained, the present invention can be applied to the case where an image is formed by a PWM system.

When the image is formed by the PWM system, since pixels having different tone (darkness/lightness) fundamentally (in actual, pixels area-modulated to have different sizes so that they are recognized as difference in tone (darkness) by human's eyes) can be formed, by merely reading density distribution of the pixels by means of the reader portion, uneven density of individual pixel can be corrected.

However, in order to read all of the pixels without deviation, high accurate reading is required. Thus, in effect, it is difficult to judge the property per pixel formed by the printer engine from the read image. If the resolving power of the printer is 600 dpi, it is required for reading the image with deviation smaller than 1/600 inch. This is very difficult, in effect. Accordingly, as mentioned above, even when the image is formed by the PWM system, it is desirable that, on the basis of an average value of the read values of a plurality of pixels continuous in the main scanning direction, the uneven density in the main scanning direction is detected and corrected.

Incidentally, while an example that the copying machine is used was explained, the present invention may be applied to a system comprised of a plurality of equipments (for example, a host computer, an interface device, a reader and a printer). In this case, since the processing can be effected in a part corresponding to the host computer, the present invention can be realized by supplying a recording medium storing a software program code for achieving the function of the aforementioned embodiment to the system or equipment so that a computer (or CPU or MPU) of the system or equipment reads out and executes the program code. In this case, since the program code itself readout from the recording medium achieves the function the aforementioned embodiment, the recording medium storing the program code constitutes the present invention.

The recording medium for supplying the program code may be, for example, a floppy disc, a hard disc, an optical disc, a photo-magnetic disc, a CD-ROM, a CD-RAM, a magnetic tape, a non-volatile memory card or a ROM.

Further, it should be noted that, by executing the program code read out by the computer, not only the function the aforementioned embodiment can be achieved, but also, on the basis of instruction of the program code, the actual processing can be partially or totally performed by OS (operating system) operated on the computer to achieve the function the aforementioned embodiment.

Further, it should be noted that, after the program code read out from the recording medium is written in a function expansion board inserted into the computer or in a memory provided in a function expansion unit connected to the computer, on the basis of instruction of the program code, the actual processing can be partially or totally performed by the function expansion board or a CPU provided in the function expansion unit to achieve the function the aforementioned embodiment.

As apparent from the above explanation, according to the illustrated embodiment, in the image forming apparatus comprising the charging means, electrostatic latent image forming means, developing means transfer means, fixing means and image bearing member surface cleaning means, when the fact that the temperature of the fixing means upon powered-On of the power supply is the predetermined temperature or lower is detected and when the fact that the water vapor amount in the surrounding environment is the predetermined water vapor amount or larger is detected, in a condition that the operating preparation of the electrostatic latent image forming means is incomplete, since the developer image is formed ont he image bearing member by operating the charging means, minute spot pattern or minute line pattern forming means, developing means and image bearing member surface cleaning means, in the image formation effected in the condition of the First Early in the Morning under the high humidity environment, a uniform high quality image having less density and no smeared image and having high density can be formed, and the starting preparation time can be shortened.

Fourth Embodiment

Now, a fourth embodiment of the present invention will be explained with reference to FIG. 1. An image forming apparatus shown in FIG. 1 is a laser beam printer (referred to as "image forming apparatus" hereinafter), and FIG. 1 is a sectional view showing a schematic construction of the apparatus. Explanation of elements same as those in the above embodiment will be omitted.

Hereinbelow, a high humidity smeared image preventing sequence utilizing user CV (copy volume) judgement which is one of characteristics of the present invention is shown. Conditions of the sequence for each purpose are as follows. Incidentally, "toner black belt" described hereinbelow is referred to as a belt-shaped toner image formed on the surface of the photosensitive drum to abrade the surface of the photosensitive drum.

EXAMPLE 1

Small CV First Early in the Morning Toner Black Belt+Idle Rotation

Summary: When an environment is a predetermined water vapor amount or larger and a fixing thermistor temperature upon switched-ON of a main switch is a predetermined temperature or lower, if a difference between present machine count and previous machine count is greater than a predetermined sheet number or value, it is judged as large CV user, and normal "HH Morning Toner Black Belt+Idle Rotation" is effected; whereas, if the difference is below the predetermined sheet number, it is judged as small CV user, and "HH Morning Toner Black Belt+Idle Rotation" having fewer amount of the black belt is effected.

"Toner Black Belt+Idle Rotation" means that the Idle Rotation of the drum (and Idle Rotations of the developing device and cleaner system, as is in the conventional case) is effected, and, substantially at the same time as the start of the Idle Rotation, primary-charging, laser exposure and development are effected on the drum, thereby forming the toner black belt.

Conditions (1) First Early in the Morning judgement (which represents to check a state of the apparatus when the main switch is turned on first on that day after the main switch is turned off on the previous day): the fixing thermistor temperature upon switched-ON of the main switch is 100° C. or lower (2) HH (high temperature and high humidity) judgement: the water vapor amount W is 9 g or larger (3) CV judgement and Black Belt length (a length of the black belt in a moving direction of the photosensitive member): Definition ΔCNT: counter difference upon powered-ON of power supply at T≦100° C.

Large CV judgement: ΔCNT≧1000 then A

Small CV judgement: ΔCNT<1000 then B (4) Idle Rotation time: From immediately after the First Early in the Morning HH judgement to the fixing thermistor temperature of 195° C., the Idle Rotation is effected for about 4.5 minutes (The rotation time is varied with fixing thermistor temperature upon initiation of the Idle Rotation).

(5) Primary charge: Output having a control value in yesterday (if no data, default output). The output time is a time corresponding to a width of the black belt.

(6) Laser: Output having a power control value in yesterday. Solid output of image area with FF hex. The output time is a time corresponding to the width of the black belt.

(7) Development: Output having a DC control value in yesterday. AC+DC (if no data, default output). The output time is a time corresponding to a width of the black belt. It is desired that DC value can be inputted.

Black belt density is to be investigated.

(8) Black belt width:

Sub-scanning direction length: on the surface of the drum, A=400 mm, B=100 mm. Sub-scanning direction length of apparatus to be investigated can be changed by input.

Main scanning direction length: Denomination width of A3 width parted down in the center of image area (not including lateral registration tolerance)

Timing: Substantially the same as initiation of Idle Rotation. With "Toner Black Belt+Idle Rotation", a density under JJ First Early in the Morning is improved from 1.2 to 1.32 (It was ascertained that, regarding the black belt width of about 84 mm, the smeared image is eliminated by effecting the Idle Rotation for three minutes).

EXAMPLE 2

HH, JJ (Normal Temperature & Normal Humidity), NL (Normal Temperature & Low Humidity) Small CV First Early in the Morning Toner Black Belt+ Idle Rotation and its Variations Summary: When a fixing thermistor temperature upon switched-ON of a main switch is a predetermined temperature or lower, on the basis of the following water vapor amount of an environment, if a difference between present machine count and previous machine count is equal to or greater than predetermined sheet number, it is judged as large CV user, and normal "HH Morning Toner Black Belt+Idle Rotation" is effected; whereas, if the difference is below the predetermined sheet number, it is judged as small CV user, and "HH Morning Toner Black Belt+Idle Rotation" having fewer amount of the black belt is effected.

"Toner Black Belt+Idle Rotation" means that the Idle Rotation of the drum (and Idle Rotations of the developing device and cleaner system, as is in the conventional case) is effected, and, substantially at the same time as the initiation of the Idle Rotation, primary-charging, laser exposure and development are effected on the drum, thereby forming the toner black belt.

(a) First Early in the Morning Black Belt+Idle Rotation: Water vapor amount W≧9 g (b) First Early in the Morning Idle Rotation: Water vapor amount 9 g>W≧5 g (c) Normal Pre-Multi Rotation Only: Water vapor amount less than 5 g Conditions (1) First Early in the Morning Judgement: the fixing thermistor temperature upon switched-ON of the main switch is 100° C. or lower (2) HH Judgement:

(a) First Early in the Morning Black Belt+Idle Rotation: Water vapor amount W≧9 g (b) First Early in the Morning Idle Rotation: Water vapor amount 9 g>W≧5 g (c) Normal Pre-Multi Rotation Only: Water vapor amount less than 5 g (3) CV judgement and Black belt length: Definition ΔCNT: counter difference upon powered-ON of power supply at T≦100° C.

Large CV judgement: ΔCNT≧1000 then A

Small CV judgement: ΔCNT<1000 then B (4) Idle Rotation time: From immediately after the First Early in the Morning HH judgement to the fixing thermistor temperature of 195° C., the Idle Rotation is effected for about 4.5 minutes (The rotation time is varied with fixing thermistor temperature upon initiation of the Idle Rotation).

(5) Primary charge: Output having a control value in yesterday (if no data, default output). The output time is a time corresponding to a width of the black belt.

(6) Laser: Output having a power control value in yesterday. Solid output of image area with FF hex. The output time is a time corresponding to the width of the black belt.

(7) Development: Output having a DC control value in yesterday. AC+DC (if no data, default output). The output time is a time corresponding to a width of the black belt. It is desired that DC value can be inputted. Black belt density is to be investigated.

(8) Black belt:

Sub-scanning direction length: on the surface of the drum, A=400 mm, B=100 mm. Sub-scanning direction length of apparatus to be investigated can be changed by input.

Main scanning direction length: Denomination width of A3 width parted down in the center of image area (not including lateral registration tolerance) Timing: Substantially the same as initiation of Idle Rotation. With "Toner Black Belt+Idle Rotation", a density under JJ First Early in the Morning is improved from 1.2 to 1.32 (It was ascertained that, regarding the black belt width of about 84 mm, the flow is eliminated by effecting the Idle Rotation for three minutes).

Figure 22:
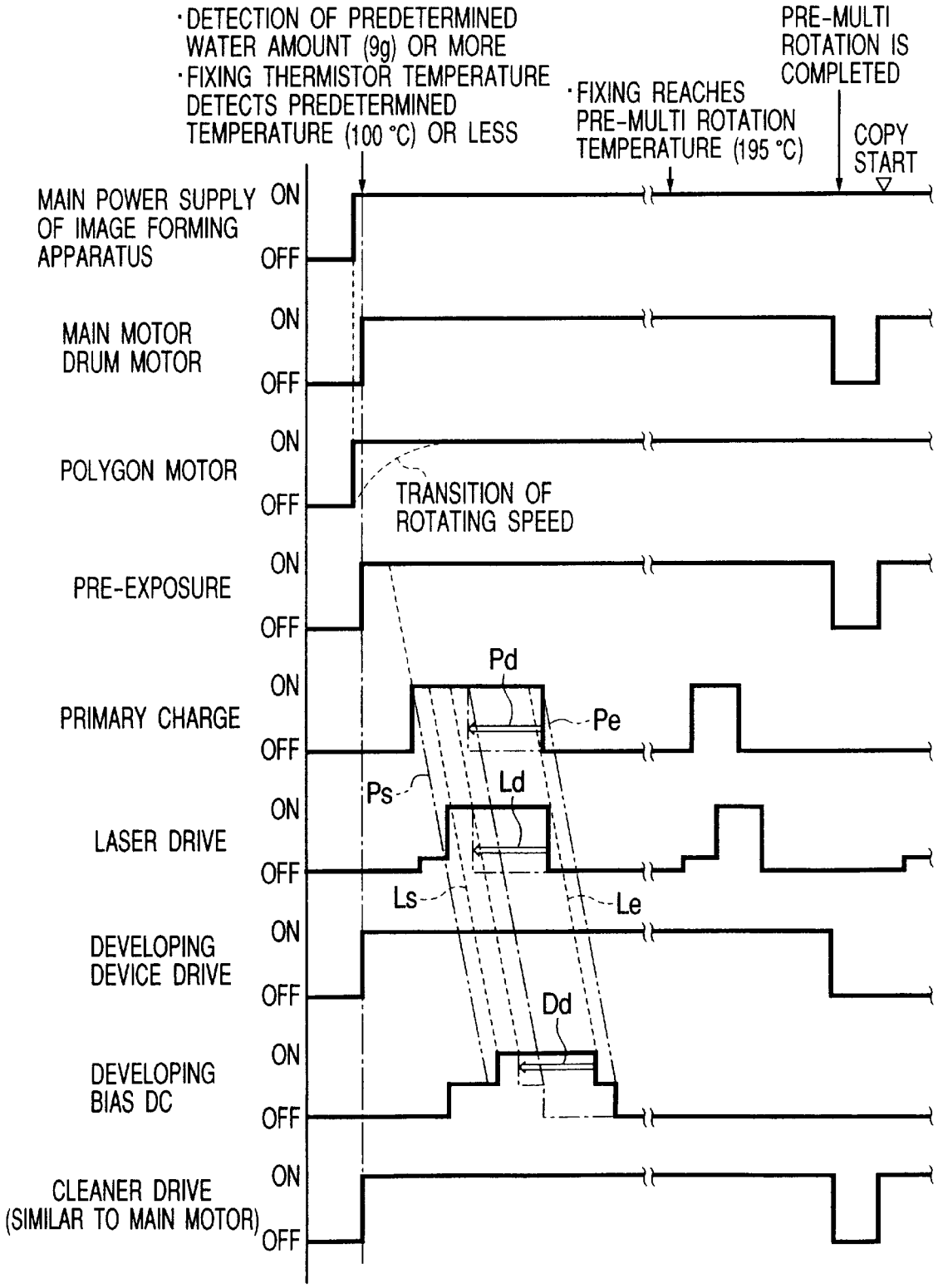
FIG. 22 is a view showing a sequence according to a fifth embodiment of the present invention.

Now, an operation in <Example 2> according to the illustrated embodiment will be explained in order with reference to FIG. 22.

In summary, when an environment is a predetermined water vapor amount or larger and a fixing thermistor temperature upon switched-ON of a main switch is a predetermined temperature or lower, if a difference between present machine count and previous machine count is equal to or greater than a predetermined sheet number, it is judged as large CV user, and normal "HH Morning Toner Black Belt+Idle Rotation" is effected; whereas, if the difference is smaller than the predetermined sheet number, it is judged as small CV user, and "HH Morning Toner Black Belt+Idle Rotation" having fewer amount of the black belt is effected.

Explaining more specifically, when the fact that the fixing thermistor temperature upon switched-ON of the main switches is equal to or lower than the predetermined temperature of 100° C. is detected and when the fact that the environment is in the predetermined water vapor amount range (water vapor amount W≧9 g) is detected, it is judged as First Early in the Morning and high humidity environment (a), and a drum driving motor is operated to effect the Idle Rotation of the drum, and, at the same time, a developing device driving motor is operated to rotate a sleeve (development sleeve) of the developing device, and, at the same time, a cleaner system driving motor is operated to effect the Idle Rotation of the cleaner system. Further, upon switched-ON of the main switch, the rotation driving of the polygon mirror in a laser scanning system starts the operation simultaneously.

Further, substantially at the same time, the primary charging is effected on a position of the drum corresponding to a pre-exposure position upon initiation of the Idle Rotation. Regarding the charging amount, output is effected by using the control value in yesterday, i.e., the last potential control value when the power supply was previously powered ON. Further, if there is no previous data, output is effected with a program default value. The output time is a time corresponding to the width of the black belt or more, and slight margin charging areas (about 10 mm) are provided before and after the black belt. In FIG. 22, $P_s$ is a charging start point and $P_e$ is a charging finish point. When the count difference is greater than the predetermined sheet number, it is judged as large CV user, and the charging is effected for a time corresponding to the normal width, and for a time corresponding to 400 mm or more in a circumferential direction of the drum in total.

Further, when the count difference is smaller than the predetermined sheet number, it is judged as small CV user, and the amount of the black belt is controlled to be smaller (as an example, the charging time is controlled to be a time obtained by adding the margin to 100 mm). Namely, the charging finish point is controlled to be shifted from $P_e$ to $P_d$, so that the charging time is shortened.

Regarding a length in the main scanning direction, the charging is effected on an area equal to or greater than the denomination width of A3 width parted down in the center of the dot area.

Then, the laser exposure is started even when the number of revolutions of the polygon mirror does not reach the predetermined number of revolutions. Namely, regarding the beam illumination pattern on the drum, first of all, starting from a pattern in which minute dots and blanks are repeated alternately, lengths of the dots and blanks are gradually shortened to ultimately provide a continuous minute line pattern. Regarding the lightening of the laser, output is effected with the previous power control value. Further, if there is no previous data, output is effected with the program default value. As the image data level, solid output of the image area is effected with FF hex. The length in the main scanning direction is the denomination width of A3 width parted down in the center of the image area. Namely, the laser beam scanning is effected in the width not including adjusting tolerance of main scanning direction registration (lateral registration). Here, FF hex output of image area of 297 mm is effected.

The output time is a time corresponding to the width of the black belt, and is a time corresponding to the length of the black belt in accordance with the CV judgement in the circumferential direction on the drum in the illustrated embodiment.

Similar to the primary charging, in the large CV judgement, the black belt forming exposure start point of the laser is indicated by "$L_s$" and the finish point is indicated by "$L_e$". In the small CV judgement, the illumination time is shortened as shown by "$L_a$".

CV judgement and black belt length are as follows:

Definition ΔCNT: difference between the counter value upon powered-ON of power supply and the previous counter value at T≦100° C.

Large CV judgement: ΔCNT≧1000 then A

Small CV judgement: ΔCNT<1000 then B Black belt:

Sub-scanning direction length: on the surface of the drum, A=400 mm, B=100 mm.

Timing: Substantially the same as initiation of Idle Rotation

Further, in order to hasten the rising of the laser output prior to output of FF hex, the laser is slightly lightened by flowing the bias current.

Then, in the development, although AC voltage+DC voltage is outputted, AC voltage is outputted with standard voltage and DC voltage is outputted with a previous DC control value. In the illustrated embodiment, although the black belt width is the DC control value of 280 V, in order to completely cover the area (before and after the black belt width) in which the primary-charge is outputted, DC control value of 300 V for the non-image area is outputted to minimize reverse-development in the area subjected to the primary-charging alone. Although FIG. 22 shows only DC voltage, AC voltage (not shown) is ON in the area further covering the DC voltage area (non-imaged area). Further, if there is no previous data, DC control value output is effected with the program default value. The output time is a time corresponding to the width of the black belt, and, similar to the laser illumination, in the large CV judgement, the developing start point for black belt formation is indicated by "$L_s$" and the finish point is indicated by "$L_e$". In the small CV judgement, the developing time is shortened as shown by "$D_d$".

According to the illustrated embodiment, in the large CV judgement, control is effected at a time corresponding to 400 mm in the circumferential direction on the drum. In the small CV judgement, the control is effected at a time corresponding to 100 mm in the circumferential direction on the drum. Further, the DC value can be inputted through the operation panel and is set so that the density of the black belt can be changed.

After the toner black belt is formed on the drum, the Idle Rotation process is performed. In an early initial phase of this process, the toner black belt is brought up to the drum cleaning device, where the black belt is stopped by an edge of a cleaning blade and laminated substances on the surface of the drum is scraped off by the toner accumulated here. Since the scraping effect is proportional to the abrading time, in order to provide the longest time, the formation of the black belt is started prior to the starting of the laser polygon mirror, thereby reserving the time. When the formation of the black belt is included, this rotation is continued from immediately after the First Early in the Morning HH judgement to the fixing thermistor temperature of 195° C. and is continued for about 4.5 minutes until the Normal Pre-Multi Rotation is started. However, the rotation time is varied with the fixing thermistor temperature upon initiation of the Idle Rotation. For example, when the rotation is started from the fixing thermistor temperature of about 90° C., since a time period required for increasing the temperature is short, the rotation time is reduced accordingly. In this case, since the fixing thermistor temperature is higher than a room temperature, in actual, there is an ample possibility for no First Early in the Morning, and, thus, since long time Idle Rotation is not required (there is no problem), it is regarded as maximum time Idle Rotation in that condition. Further, in this case, the Idle Rotation of the developing device is also effected, so that the charging amount of the developer in which the rising of the charging amount become difficult due to moisture absorption is gradually increased, with the result that the adequate density can be achieved until the Pre-Multi Rotation is reached, and the developing ability is increased sufficient to adequately preserve reproducing ability of individual dot. As a result, in a copy image obtained in the condition of the First Early in the Morning under the high humidity environment, there is no smeared image, thereby obtaining a uniform high quality image with high density.

As mentioned above, regarding the smeared image, even in the most severe high humidity environment (having water vapor amount of 9 g/m$^3$), the good image can be obtained from immediately after the starting of the image forming apparatus regardless of the environment, and, when the number of copies to be desired is small, since the toner can be used under appropriate automatic control, toner consumption, excessive consumption of resources and copy/print cost can be reduced.

As mentioned above, when an environment is a predetermined water vapor amount or larger and a fixing thermistor temperature upon switched-ON of a main switch is a predetermined temperature or lower, if a difference between present machine count and previous machine count is equal to or greater than a predetermined sheet number, it is judged as large CV user, and normal "HH Morning Toner Black Belt+Idle Rotation" is effected; whereas, if the difference is below the predetermined sheet number, it is judged as small CV user, and "HH Morning Toner Black Belt+Idle Rotation" having fewer amount of the black belt is effected. As a result, even when the number of copies to be desired is small, the toner consumption is prevented from being increased excessively in comparison with the number of copies so that the cost per one copy can be reduced, and, at the same time, even when the image forming apparatus having the a-Si photosensitive member in the laser scan/exposure system is used under the high humidity environment, if the ozone and discharged products generated by the corona discharging or rubber substance stripped from the pick-up roller and/or conveying roller are adhered to the surface of the photosensitive member, the occurrence of the smeared image can be prevented.

Hereinbelow, a high humidity smeared image preventing sequence utilizing user CV (copy volume) judgement which is one of characteristics of the present invention is shown. Conditions of the sequence for each purpose are as follows:

EXAMPLE

Small CV First Early in the Morning Toner Black Belt+Idle Rotation

Summary: When an environment is a predetermined water vapor amount or larger and a fixing thermistor temperature upon switched-ON of a main switch is a predetermined temperature or lower, if a difference between present machine count and previous machine count is equal to or greater than a predetermined sheet number, it is judged as large CV user, and normal "HH Morning Toner Black Belt+Idle Rotation" is effected; whereas, if the difference is smaller than the predetermined sheet number, it is judged as small CV user, and "HH Morning Toner Black Belt+Idle Rotation" having fewer amount of the black belt is effected.

"Toner Black Belt+Idle Rotation" means that the Idle Rotation of the drum (and Idle Rotations of the developing device and cleaner system, as is in the conventional case) is effected, and, substantially at the same time as the Idle Rotation, primary-charging, laser exposure and development are effected on the drum, thereby forming the toner black belt.

Conditions (1) First Early in the Morning judgement: the fixing thermistor temperature upon switche-ON of the main switch is 100° C. or lower (2) HH (high temperature and high humidity) judgement: the water vapor amount is 9 g or larger (3) CV judgement and Black belt length: Definition ΔCNT: counter difference upon powered-ON of power supply at T≦100° C.

Large CV judgement: ΔCNT≧1000 then A

Small CV judgement: ΔCNT<1000 then B

ΔCNT for CV judgement can be inputted.

(4) Idle Rotation time: From immediately after the First Early in the Morning HH judgement to the fixing thermistor temperature of 195° C., the Idle Rotation is effected for about 4.5 minutes (The rotation time is varied with fixing thermistor temperature upon initiation of the Idle Rotation).

(5) Primary charge: Output having a control value in yesterday (if no data, default output). The output time is a time corresponding to a width of the black belt.

(6) Laser: Output having a power control value in yesterday. Solid output of image area with FF hex. The output time is a time corresponding to the width of the black belt.

(7) Development: Output having a DC control value in yesterday. AC+DC (if no data, default output). The output time is a time corresponding to a width of the black belt. It is desired that DC value can be inputted. Black belt density is to be investigated.

(8) Black Belt:

Sub-scanning direction length: on the surface of the drum, A=300 mm, B=50 mm. Sub-scanning direction length of apparatus to be investigated can be changed by input.

Main scanning direction length: Denomination width of A3 width parted down in the center of image area (not including lateral registration tolerance)

Timing: Substantially the same as initiation of Idle Rotation. With "Toner Black Belt+Idle Rotation", a density under JJ First Early in the Morning is improved from 1.2 to 1.32 (It was ascertained that, regarding the black belt of about 84 mm, the smeared image is eliminated by effecting the Idle Rotation for three minutes).

Now, an operation of the illustrated embodiment will be explained in order with reference to FIG. 22.

In summary, when an environment is a predetermined water vapor amount or larger and a fixing thermistor temperature upon switched-ON of a main switch is a predetermined temperature or lower, if a difference between present machine count and previous machine count is equal to or greater than a predetermined sheet number, it is judged as large CV user, and normal "HH Morning Toner Black Belt+Idle Rotation" is effected; whereas, if the difference is smaller than the predetermined sheet number, it is judged as small CV user, and "HH Morning Toner Black Belt+Idle Rotation" having fewer amount of the black belt is effected.

Explaining more specifically, when the fact that the fixing thermistor temperature upon switched-ON of the main switch is the predetermined temperature of 100° C. or lower is detected and when the fact that the environment is in the predetermined water vapor amount range (water vapor amount $W \geqq 9$ g) is detected, it is judged as First Early in the Morning and high humidity environment (a), and a drum driving motor is operated to effect the Idle Rotation of the drum, and, at the same time, a developing device driving motor is operated to rotate a sleeve (development sleeve) of the developing device, and, at the same time, a cleaner system driving motor is operated to effect the Idle Rotation of the cleaner system. Further, upon switched-ON of the main switch, the rotation driving of the polygon mirror in a laser scanning system starts the operation simultaneously.

Further, substantially at the same time, the primary charging is effected on a position of the drum corresponding to a pre-exposure position upon initiation of the Idle Rotation. Regarding the charging amount, output is effected by using the control value in yesterday, i.e., the last potential control value when the power supply was previously powered ON. Further, if there is no previous data, output is effected with a program default value. The output time is a time corresponding to the width of the black belt or more, and slight margin charging areas (about 10 mm) are provided before and after the black belt. In FIG. 22, $P_s$ is a charging start point and $P_e$ is a charging finish point. When the count difference is equal to or greater than the predetermined sheet number, it is judged as large CV user, and the charging is effected for a time corresponding to the normal width, and for a time corresponding to 300 mm or more in a circumferential direction of the drum in total.

Further, when the count difference is smaller than the predetermined sheet number, it is judged as small CV user, and the amount of the black belt is controlled to be smaller (as an example, the charging time is controlled to be a time obtained by adding the margin to 50 mm). Namely, the charging finish point is controlled to be shifted from $P_e$ to $P_d$, so that the charging time is shortened.

Regarding a length in the main scanning direction, the charging is effected on an area greater than the denomination width of A3 width parted down in the center of the image area.

Then, the laser exposure is started even when the number of revolutions of the polygon mirror does not reach the predetermined number of revolutions. Namely, regarding the beam illumination pattern on the drum, first of all, starting from a pattern in which minute dots and blanks are repeated alternately, lengths of the dots and blanks are gradually shortened to ultimately provide a continuous minute line pattern. Regarding the lightening of the laser, output is effected with the previous power control value. Further, if there is no previous data, output is effected with the program default value. As the image data level, solid output of the image area is effected with FF hex. The length in the main scanning direction is the denomination width of A3 width parted down in the center of the image area. Namely, the laser beam scanning is effected in the width not including adjusting tolerance of main scanning direction registration (lateral registration). Here, FF hex output of image area of 297 mm is effected.

The output time is a time corresponding to the width of the black belt, and is a time corresponding to the length of the black belt in accordance with the CV judgement in the circumferential direction on the drum in the illustrated embodiment.

Similar to the primary charging, in the large CV judgement, the black belt forming exposure start point of the laser is indicated by "$L_s$" and the finish point is indicated by "$L_e$". In the small CV judgement, the point $L_e$ is shifted so that the illumination time is shortened as shown by "$L_d$".

Further, in order to hasten the rising of the laser output prior to output of FF hex, the laser is slightly lightened by flowing the bias current.

Then, in the development, although AC voltage+DC voltage is outputted, AC voltage is outputted with standard voltage and DC voltage is outputted with a previous DC control value. In the illustrated embodiment, although the black belt width is the DC control value of 280 V, in order to completely cover the area (before and after the black belt width) in which the primary-charge is outputted, DC control value of 300 V for the non-image area is outputted to minimize reverse-development in the area subjected to the primary-charging alone. Although FIG. 22 shows only DC voltage, AC voltage (not shown) is ON in the area further covering the DC voltage area (non-imaged area). Further, if there is no previous data, DC control value output is effected with the program default value. The output time is a time corresponding to the width of the black belt, and, similar to the laser illumination, in the large CV judgement, the developing start point for black belt formation is indicated by "$L_s$" and the finish point is indicated by "$L_e$". In the small CV judgement, the developing time is shortened as shown by "$D_d$".

According to the illustrated embodiment, in the large CV judgement, control is effected at a time corresponding to 300 mm in the circumferential direction on the drum. In the small CV judgement, the control is effected at a time corresponding to 50 mm in the circumferential direction on the drum. Further, the DC value can be inputted through the operation panel and is set so that the darkness of the black belt can be changed.

After the toner black belt is formed on the drum, the Idle Rotation process is performed. In an early initial phase of this process, the toner black belt is brought up to the drum cleaning device, where the black belt is stopped by an edge of a cleaning blade and laminated substances on the surface of the drum is scraped off by the toner accumulated here. Since the scraping effect is proportional to the abrading time, in order to provide the longest time, the formation of the black belt is started prior to the starting of the laser polygon mirror, thereby reserving the time. When the formation of the black belt is included, this rotation is continued from immediately after the First Early in the Morning HH judgement to the fixing thermistor temperature of 195° C. and is continued for about 4.5 minutes until the Normal Pre-Multi Rotation is started. However, the rotation time is varied with the fixing thermistor temperature upon initiation of the Idle Rotation. For example, when the rotation is started from the fixing thermistor temperature of about 90° C., since a time period required for increasing the temperature is short, the rotation time is reduced accordingly. In this case, since the fixing thermistor temperature is greater than a room temperature, in actual, there is an ample possibility for no First Early in the Morning, and, thus, since long time Idle Rotation is not required (there is no problem), it is regarded as maximum time Idle Rotation in that condition. Further, in this case, the Idle Rotation of the developing device is also effected, so that the charging amount of the developer in which the rising of the charging amount becomes difficult due to moisture absorption is gradually increased, with the result that the adequate density can be achieved until the Pre-Multi Rotation is reached, and the developing ability is increased sufficient to adequately preserve reproducing ability of individual dot. As a result, in a copy image obtained in the condition of the First Early in the Morning under the high humidity environment, there is no smeared image, thereby obtaining a uniform high quality image with high density.

As mentioned above, regarding the smeared image, even in the most severe high humidity environment (having water vapor amount of 9 g/m$^3$), the good image can be obtained from immediately after the starting of the image forming apparatus regardless of the environment, and, when the number of copies to be desired is small, since the toner can be used under appropriate automatic control, toner consumption, excessive consumption of resources and copy/print cost can be reduced.

As mentioned above, when an environment is a predetermined water vapor amount or larger and a fixing thermistor temperature upon switched-ON of a main switch is a predetermined temperature or lower, if a difference between present machine count and previous machine count is equal to or greater than a predetermined sheet number or value, it is judged as large VC user, and normal "HH Morning Toner Black Belt+Idle Rotation" is effected; whereas, if the difference is smaller than the predetermined sheet number, it is judged as small CV user, and "HH Morning Toner Black Belt+Idle Rotation" having fewer amount of the black belt is effected. As a result, even when the number of copies to be desired is small, the toner consumption is prevented from being increased excessively in comparison with the number of copies so that the cost per one copy can be reduced, and, at the same time, even when the image forming apparatus having the a-Si photosensitive member in the laser scan/exposure system is used under the high humidity environment, if the ozone and discharged products generated by the corona discharging or rubber substance stripped from the pick-up roller and/or conveying roller are adhered to the surface of the photosensitive member, the occurrence of the smeared image can be prevented.

Further, the developer is adhered to the photosensitive member to be supplied up to the cleaning device and the adequate abrading time is maintained so that the abrading effect for the surface of the photosensitive member can be enhanced, and at the same time, the starting preparation time can be greatly reduced, and, in the initial image obtained by the image forming apparatus for forming the digital data with small dots immediately after the power supply is turned ON, the smeared image can be prevented, and reduction of density and degradation of the smeared image can also be prevented. Namely, the adequate density can be achieved, and the developing ability is increased sufficient to adequately preserve reproducing ability of individual dot. As a result, in a copy image obtained in the condition of the First Early in the Morning under the high humidity environment, a uniform high quality image having no smeared image and no longitudinal (main scanning direction) density unevenness and having high density can be obtained.

Fifth Embodiment

FIG. 18 is a schematic constructural view of an image forming apparatus according to a fifth embodiment of the present invention. Explanation of elements same as those in the above embodiment will be omitted.

Hereinbelow, a high humidity smeared image preventing sequence utilizing user CV (copy volume) judgement which is one of characteristics of the present invention is shown. Conditions of the sequence for each purpose are as follows.

EXAMPLE

JJ (Normal Temperature & Normal Humidity), NL (Normal Temperature & Low Humidity) Small CV First Early in the Morning Toner Black Belt+Idle Rotation and its Variations Summary: When a fixing thermistor temperature upon switched-ON of a main switch is a predetermined temperature or lower, on the basis of the following water vapor amount range of an environment, if a difference between present machine count and previous a machine count is equal to or greater than a predetermined sheet number, it is judged as large CV user, and normal "HH Morning Toner Black Belt+Idle Rotation" is effected; whereas, if the difference is smaller than the predetermined sheet number, it is judged as small CV user, and "HH Morning Toner Black Belt+Idle Rotation" having fewer amount of the black belt is effected.

"Toner Black Belt+Idle Rotation" means that the Idle Rotation of the drum (and Idle Rotations of the developing device and cleaner system, as is in the conventional case) is effected, and, substantially at the same time as the initiation of the Idle Rotation, primary-charging, laser exposure and development are effected on the drum, thereby forming the toner black belt.

(a) First Early in the Morning Black Belt+Idle Rotation: Water vapor amount $W \geqq 9$ g (b) First Early in the Morning Idle Rotation: Water vapor amount $9 \text{ g} > W \geqq 5$ g (c) Normal Pre-Multi Rotation Only: Water vapor amount less than 5 g Conditions (1) First Early in the Morning Judgement: the fixing thermistor temperature upon switched-ON of the main switch is 100° C. or larger (2) HH Judgement:

(a) First Early in the Morning Black Belt+Idle Rotation: Water vapor amount $W \geqq 9$ g (b) First Early in the Morning Idle Rotation: Water vapor amount $9 \text{ g} > W \geqq 5$ g (c) Normal Pre-Multi Rotation Only: Water vapor amount less than 5 g (3) CV judgement and Black Belt length: Definition ΔCNT: counter difference upon powered-ON of power supply at $T \leqq 100°$ C.

Large CV judgement: $\Delta CNT \geqq 500$ then A

Small CV judgement: $\Delta CNT < 500$ then B (4) Idle Rotation time: From immediately after the First Early in the Morning HH judgement to the fixing thermistor temperature of 195° C., the Idle Rotation is effected for about 4.5 minutes (The rotation time is varied with fixing thermistor temperature upon initiation of the Idle Rotation).

(5) Primary charge: Output having a control value in yesterday (if no data, default output). The output time is a time corresponding to a width of the black belt.

(6) Laser: Output having a power control value in yesterday. Solid output of image area with FF hex. The output time is a time corresponding to the width of the black belt.

(7) Development: Output having a DC control value in yesterday. AC+DC (if no data, default output). The output time is a time corresponding to a width of the black belt. It is desired that DC value can be inputted. Black belt density is to be investigated.

(8) Black Belt:

Sub-scanning direction length: on the surface of the drum, A=100 mm, B=20 mm. Sub-scanning direction length of apparatus to be investigated can be changed by input.

Main scanning direction length: Denomination width of A3 width parted down in the center of image area (not including lateral registration tolerance) Timing: Substantially the same as initiation of Idle Rotation. With "Toner Black belt+Idle Rotation", a density under JJ First Early in the Morning is improved from 1.1 to 1.40 (It was ascertained that, regarding the black belt width of about 100 mm, the flow is eliminated by effecting the Idle Rotation for three minutes).

Now, an operation of the illustrated embodiment will be explained in order with reference to FIG. 22.

In summary, when an environment is a predetermined water vapor amount or larger and a fixing thermistor temperature upon ON of a main switch is below a predetermined temperature, if a difference between present machine count and previous machine count is equal to or greater than a predetermined sheet number, it is judged as large CV user, and normal "HH Morning Toner Black Belt+Idle Rotation" is effected; whereas, if the difference is smaller than the predetermined sheet number, it is judged as small CV user, and "HH Morning Toner Black Belt+Idle Rotation" having fewer amount of the black belt is effected.

Explaining more specifically, when the fact that the fixing thermistor temperature upon switched-On of the main switch is the predetermined temperature of 100° C. or lower is detected and when the fact that the environment is in the predetermined water vapor amount range (water vapor amount $W \geqq 9$ g) is detected, it is judged as First Early in the Morning and high humidity environment (a), and a drum driving motor is operated to effect the Idle Rotation of the drum, and, at the same time, a developing device driving motor is operated to rotate a sleeve (development sleeve) of the developing device, and, at the same time, a cleaner system driving motor is operated to effect the Idle Rotation of the cleaner system. Further, upon switched-ON of the main switch, the rotation driving of the polygon mirror in a laser scanning system starts the operation simultaneously.

Further, substantially at the same time, the primary charging is effected on a position of the drum corresponding to a pre-exposure position upon initiation of the Idle Rotation. Regarding the charging amount, output is effected by using the control value in yesterday, i.e., the last potential control value when the power supply was previously powered ON. Further, if there is no previous data, output is effected with a program default value. The output time is a time corresponding to the width of the black belt or more, and slight margin charging areas (about 10 mm) are provided before and after the black belt. In FIG. 22, $P_s$ is a charging start point and $P_e$is a charging finish point. When the count difference is equal to or greater than the predetermined sheet number, it is judged as large CV user, and the charging is effected for a time corresponding to the normal width, and for a time corresponding to 100 mm or more in a circumferential direction of the drum in total.

Further, when the count difference is smaller than the predetermined sheet number, it is judged as small CV user, and the amount of the black belt is controlled to be smaller (as an example, the charging time is controlled to be a time obtained by adding the margin to 20 mm). Namely, the charging finish point is controlled to be shifted from $P_e$ to $P_d$, so that the charging time is shortened.

Regarding a length in the main scanning direction, the charging is effected on an area equal to or greater than the denomination width of A3 width parted down in the center of the image area.

Then, the laser exposure is started even when the number of revolutions of the polygon mirror does not reach the predetermined number of revolutions. Namely, regarding the beam illumination pattern on the drum, first of all, starting from a pattern in which minute dots and blanks are repeated alternately, lengths of the dots and blanks are gradually shortened to ultimately provide a continuous minute line pattern. Regarding the lightening of the laser, output is effected with the previous power control value. Further, if there is no previous data, output is effected with the program default value. As the image data level, solid output of the image area is effected with FF hex. The length in the main scanning direction is the denomination width of A3 width parted down in the center of the image area. Namely, the laser beam scanning is effected in the width not including adjusting tolerance of main scanning direction registration (lateral registration). Here, FF hex output of image area of 297 mm is effected.

The output time is a time corresponding to the width of the black belt, and is a time corresponding to the length of the black belt in accordance with the CV judgement in the circumferential direction on the drum in the illustrated embodiment.

Similar to the primary charging, in the large CV judgement, the black belt forming exposure start point of the laser is indicated by "$L_s$" and the finish point is indicated by "$L_e$". In the small CV judgement, the illumination time is shortened as shown by "$L_d$".

Further, in order to hasten the rising of the laser output prior to output of FF hex, the laser is slightly lightened by flowing the bias current.

Then, in the development, although AC voltage+DC voltage is outputted, AC voltage is outputted with standard voltage and DC voltage is outputted with a previous DC control value. In the illustrated embodiment, although the black belt width is the DC control value of 280 V, in order to completely cover the area (before and after the black belt width) is which the primary-charge is outputted, DC control value of 300 V for the non-image area is outputted to minimize reverse-development in the area subjected to the primary-charging alone. Although FIG. 22 shows only DC voltage, AC voltage (not shown) is ON in the area further covering the DC voltage area (non-imaged area). Further, if there is no previous data, DC control value output is effected with the program default value. The output time is a time corresponding tot he width of the black belt, and, similar to the laser illumination, in the large CV judgement, the developing start point for black belt formation is indicated by "$L_s$" and the finish point is indicated by "$L_e$". In the small CV judgement, the developing time is shortened as shown by "$D_d$".

According to the illustrated embodiment, in the large CV judgement, control is effected at a time corresponding to 100 mm in the circumferential direction on the drum. In the small CV judgement, the control is effected at a time corresponding to 20 mm in the circumferential direction on the drum. Further, the DC value can be inputted through the operation panel and is set so that the darkness of the black belt can be changed.

After the toner black belt is formed on the drum, the Idle Rotation process is performed. In an early initial phase of this process, the toner black belt is brought up to the drum cleaning device, where the black belt is stopped by an edge of a cleaning blade and laminated substances on the surface of the drum is scraped off the toner accumulated here. Since the scraping effect is proportional to the abrading time, in order to provide the longest time, the formation of the black belt is started prior to the starting of the laser polygon mirror, thereby reserving the time. When the formation of the black belt is included, this rotation is continued from immediately after the First Early in the Morning HH judgement to the fixing thermistor temperature of 195° C. and is continued for about 4.5 minutes until the Normal Pre-Multi Rotation is started. However, the rotation time is varied with the fixing thermistor temperature upon initiation of the Idle Rotation. For example, when the rotation is started from the fixing thermistor temperature of about 90° C., since a time period required for increasing the temperature is short, the rotation time is reduced accordingly. In this case, since the fixing thermistor temperature is greater than a room temperature, in actual, there is an ample possibility for no First Early in the Morning, and, thus, since long time Idle Rotation is not required (there is no problem), it is regarded as maximum time Idle Rotation in that condition. Further, in this case, the Idle Rotation of the developing device is also effected, so that the charging amount of the developer in which the rising of the charging amount becomes difficult due to moisture absorption is gradually increased, with the result that the adequate density can be achieved until the Pre-Multi Rotation is reached, and the developing ability is increased sufficient to adequately preserve reproducing ability of individual dot. As a result, in a copy image obtained in the condition of the First Early in the Morning under the high humidity environment, there is no smeared image, thereby obtaining a uniform high quality image with high density.

As mentioned above, regarding the smeared image, even in the most severe high humidity environment (having water vapor amount of 9 g/m$^3$), the good image can be obtained from immediately after the starting of the image forming apparatus regardless of the environment, and, when the number of copies to be desired is small, since the toner can be used appropriate automatic control, toner consumption, excessive consumption of resources and copy/print cost can be reduced.

As mentioned above, according to the present invention, even when the number of copies to be desired is small, the toner consumption for abrading the surface of the photosensitive member (image bearing member) is prevented from being increased excessively in comparison with the number of copies so that the cost per one copy can be reduced, and, at the same time, even when the image forming apparatus having the a-Si photosensitive member in the laser scan/exposure system is used under the high humidity environment, if the ozone and discharged products generated by the corona discharging or rubber substance stripped from the pick-up roller and/or conveying roller are adhered to the surface of the photosensitive member, the occurrence of the smeared image can be prevented.

Further, the developer is adhered to the photosensitive member to be supplied up to the cleaning device and the adequate abrading time is maintained so that the abrading effect for the surface of the photosensitive member can be enhanced, and at the same time, the starting preparation time can be greatly reduced, and, in the initial image obtained by the image forming apparatus for forming the digital data with small dots immediately after the power supply is turned ON, the smeared image can be prevented, and reduction of density and degradation of the smeared image can also be prevented.

What is claimed is:

1. An image forming apparatus for effecting an image exposure on an electrophotographic photosensitive member by a digital optical system device, comprising:

charging means for charging said electrophotographic photosensitive member;

electrostatic latent image forming means for forming a minute dot pattern corresponding to image data;

developing means for bearing developer on a developer bearing member to convey the developer to a developing portion opposed to said photosensitive member and for forming a development electric field between said photosensitive member and said developer bearing member in said developing portion to develop a latent image on said photosensitive member with the developer;

transfer means for transferring a developer image onto a transfer material;

fixing means for fixing the developer image transferred on the transfer material;

photosensitive member surface cleaning means for cleaning residual developer remaining on a surface of said photosensitive member after transferring;

means for detecting temperature of said fixing means; and means for detecting a water vapor amount in a surrounding environment; wherein when a power supply of the apparatus is powered ON, and if a fact that the temperature of said fixing means is a predetermined temperature or lower is detected and if a fact that the water vapor amount in the surrounding environment is a predetermined water vapor amount or larger is detected, said charging means, optical system means for forming a minute dot pattern or minute line pattern, said developing means and said photosensitive member surface cleaning means are operated to abrade said photosensitive member under a state that a preparation of a starting operation of said electrostatic latent image forming means for image formation is not completed.

2. An image forming apparatus according to claim 1, wherein, after the operations of said optical system means, said developing means and said photosensitive member surface cleaning means are started, said developing means and said cleaning means are operated under a non-image forming condition, and at the same time, cleaning means for said transfer means and said charging means are subjected to predetermined operation, and, thereafter, if the water vapor amount is smaller than the predetermined water vapor amount when the temperature of said fixing means reaches a fixing permitting temperature, a preparing operation for normal image formation is restored.

3. An image forming apparatus according to claim 1, wherein said optical system means starts to form the minute dot pattern or minute line pattern at a light scanning speed lower than a light scanning speed of the normal image formation.

4. An image forming apparatus according to claim 1, wherein said optical system means scans a laser beam by a rotary mirror.

5. An image forming apparatus according to claim 1, wherein said optical system means drives a plurality of light emitting elements arranged in a main scanning direction.

6. An image forming apparatus according to claim 1, wherein said means for detecting the water vapor amount in the surrounding environment detects a water vapor amount in an air in a vicinity of said photosensitive member.

7. An image forming apparatus according to claim 1, wherein said photosensitive member is constituted by film-coating a photoconductive layer for forming an electrostatic latent image on a conductive substrate moveable in an endless path.

8. An image forming apparatus according to claim 7, wherein said photosensitive member is a drum-shaped photosensitive member moveable in an endless path and constituted by film-coating a photoconductive layer for forming an electrostatic latent image on a cylindrical conductive substrate.

9. An image forming apparatus according to claim 7, wherein said photosensitive member comprises an a-Si photosensitive member.

10. An image forming apparatus according to claim 4, wherein, before a preparation of the operation of said electrostatic latent image forming means is completed, said charging means effects a charging with a charging output value equal to a value used in a previous image formation and effects the charging over a length equal to or greater than a length of said photosensitive member in a moving direction.

11. An image forming apparatus according to claim 4, wherein, before a preparation of the operation of said electrostatic latent image forming means is completed, said optical system means effects an exposure with a black image data level (FF hex) at a lightening output value equal to that used in a previous image formation and effects the exposure over a length equal to a length of said photosensitive member in a moving direction.

12. An image forming apparatus according to claim 4, wherein, before a preparation of the operation of said electrostatic latent image forming means is completed, said optical system means effects an exposure over a length equal to a length of said photosensitive member in a moving direction, and an axial length of the developer image is smaller than an maximum exposure length at both longitudinal ends and equal to or longer than a standard image forming area.

13. An image forming apparatus according to claim 4, wherein, before a preparation of the operation of said electrostatic latent image forming means is completed, said developing means effects a development with a developing bias output value equal to that used in a previous image formation and effects the development over a length equal to a length of said photosensitive member in a moving direction.

14. An image forming apparatus for effecting an image exposure on an electrophotographic photosensitive member by a digital optical system device, comprising:

charging means for charging said electrophotographic photosensitive member;

electrostatic latent image forming means for forming a minute dot pattern corresponding to image data;

developing means for bearing developer on an developer bearing member to convey the developer to a developing portion opposed to said photosensitive member and for forming a development electric field between said photosensitive member and said developer bearing member in said developing portion to develop the latent image on said photosensitive member with the developer;

transfer means for transferring a developer image onto a transfer material;

fixing means for fixing the developer image transferred on the transfer material;

photosensitive member surface cleaning means for cleaning residual developer remaining on a surface of said photosensitive member after transferring;

means for detecting temperature of said fixing means; and means for detecting a water vapor amount in a surrounding environment; wherein a first step is effected in such a manner that, when a power supply of the apparatus is powered ON, and if a fact that the temperature of said fixing means is a predetermined temperature or lower is detected and if a fact that the water vapor amount in the surrounding environment is a predetermined water vapor amount or larger is detected, said charging means, optical system means for forming minute dot pattern or minute line pattern, said developing means and said photosensitive member surface cleaning means are operated to abrade said photosensitive member under a state that a preparation of a starting operation of said electrostatic latent image forming means for image formation is not completed;

and thereafter, a second step is effected in such a manner that said developing means and said photosensitive member surface cleaning means including a driving of said photosensitive member are operated under a condition that the image formation is not effected; and a third step which is a preparing operation as a pre-process for a normal image formation in a condition that the water vapor amount is smaller than the predetermined water vapor amount is effected at a time when the temperature of said fixing means reaches a fixing permitting temperature;

and, when a second predetermined water vapor amount range is detected, said second and third steps are effected;

and, when a third predetermined water vapor amount range is detected, said second step is not effected but said third step is effected.

15. An image forming apparatus according to claim 14, wherein the first predetermined water vapor amount range includes a water vapor amount greater than 9 $g/m^3$, the second predetermined water vapor amount range ranges from a water vapor amount smaller than 9 $g/m^3$ to a water vapor amount equal to or greater than 5 $g/m^3$, and the third predetermined water vapor amount range includes a water vapor amount smaller than 5 $g/m^3$.

16. An image forming apparatus according to claim 14, wherein said optical system means starts to form the minute dot pattern or minute line pattern at a light scanning speed lower than a light scanning speed of the normal image formation.

17. An image forming apparatus according to claim 14, wherein said optical system means scans a laser beam by a rotary mirror.

18. An image forming apparatus according to claim 14, wherein said optical system means drives a plurality of light emitting elements arranged in a main scanning direction.

19. An image forming apparatus according to claim 14, wherein said means for detecting the water vapor amount in the surrounding environment detects a water vapor amount in an air in a vicinity of said photosensitive member.

20. An image forming apparatus according to claim 14, wherein said photosensitive member is constituted by film-coating a photoconductive layer for forming an electrostatic latent image on a conductive substrate moveable in an endless path.

21. An image forming apparatus according to claim 20, wherein said photosensitive member is a drum-shaped photosensitive member moveable in an endless path and constituted by film-coating a photoconductive layer for forming an electrostatic latent image on a cylindrical conductive substrate.

22. An image forming apparatus according to claim 21, wherein said photosensitive member comprises an a-Si photosensitive member.

23. An image forming apparatus for effecting an image exposure on an electrophotographic photosensitive member by a digital optical system device, comprising:

charging means for charging said electrophotographic photosensitive member;

electrostatic latent image forming means for forming a minute dot pattern corresponding to image data;

developing means for bearing developer on an developer bearing member to convey the developer to a developing portion opposed to said photosensitive member and for forming development electric field between said photosensitive member and said developer bearing member in said developing portion to develop the latent image on said photosensitive member with the developer;

transfer means for transferring the developer image onto a transfer material;

fixing means for fixing the developer image transferred to the transfer material;

photosensitive member surface cleaning means for cleaning residual developer remaining on a surface of said photosensitive member after transferring;

temperature detecting means for detecting temperature of said fixing means;

water vapor amount detecting means for detecting a water vapor amount in a surrounding environment; and control means for controlling an image forming operation; wherein said control means for controlling the image forming operation judges as a large amount using condition of the image forming apparatus and forms a toner image for abrading the surface of said photosensitive member on said photosensitive member with a normal amount of toner under a high humidity environment if a difference between the total number of used transfer materials in the image forming apparatus when the temperature of said fixing means detected by said temperature detecting means upon power ON of a power supply is a predetermined temperature or lower and if the water vapor amount in the surrounding environment detected by said water vapor amount detecting means is a predetermined water vapor amount or larger and a previous total number of transfer materials under the same condition is a predetermined number or more, and judges as a small amount using condition if the difference is smaller than the predetermined number and forms a toner image for abrading the surface of said photosensitive member on said photosensitive member with an amount of toner smaller than the normal amount under the high humidity environment.

24. An image forming apparatus according to claim 23, wherein said control means for controlling the image forming operation forms the toner image for abrading the surface of said photosensitive member by starting operations of said charging means, said electrostatic latent image forming means, said developing means and said cleaning means in a state that a preparation of the operation of said electrostatic latent image forming means is not completed, and thereafter drives said developing means and said cleaning means in a condition that the image is not formed, and, a preparing operation for normal image formation is started at a time when the temperature of said fixing means reaches a fixing permitting temperature.

25. An image forming apparatus according to claim 23, wherein said electrostatic latent image forming means scans a laser beam by a rotary mirror.

26. An image forming apparatus according to claim 23, wherein said electrostatic latent image forming means drives a plurality of light emitting elements arranged in a main scanning direction.

27. An image forming apparatus according to claim 23, wherein said water vapor amount detecting means for detecting the water vapor amount in the surrounding environment detects a water vapor amount in an air in a vicinity of said photosensitive member.

28. An image forming apparatus according to claim 23, wherein said photosensitive member is constituted by film-coating a photoconductive layer for forming an electrostatic latent image on a conductive substrate moveable in an endless path.

29. An image forming apparatus according to claim 28, wherein said photosensitive member is a drum-shaped photosensitive member moveable in an endless path and constituted by film-coating a photoconductive layer for forming an electrostatic latent image on a cylindrical conductive substrate.

30. An image forming apparatus according to claim 29, wherein said photosensitive member comprises an a-Si photosensitive member.

31. An image forming apparatus according to claim 23, wherein, a first step is effected in such a manner that, if a fact that the water vapor amount in the surrounding environment is in a first predetermined water vapor amount range is detected by said water vapor amount detecting means, said charging means, said electrostatic latent image forming means, said developing means and said cleaning means are operated to form the toner image for abrading the surface of said photosensitive member on said photosensitive member;

and thereafter, a second step is effected in such a manner that said developing means and said cleaning means including the driving of said photosensitive member are operated in a condition that the image formation is not effected; and a third step which is a preparing operation for normal image formation in a condition that the water vapor amount is smaller than the predetermined water vapor amount is effected at a time when the temperature of said fixing means detected by said temperature detecting means reaches a fixing permitting temperature;

and, when a second predetermined water vapor amount range is detected, said second and third steps are effected;

and, when a third predetermined water vapor amount range is detected, said second step is not effected but said third step is effected.

32. An image forming apparatus according to claim 31, wherein the first predetermined water vapor amount range includes a water vapor amount equal to or greater than 9 $g/m^3$, the second predetermined water vapor amount range ranges from a water vapor amount smaller than 9 $g/m^3$ to a water vapor amount equal to or greater than 5 $g/m^3$, and the third predetermined water vapor amount range includes a water vapor amount smaller than 5 $g/m^3$.

* * * * *

UNITED STATES PATENT AND TRADEMARK OFFICE

CERTIFICATE OF CORRECTION

PATENT NO. : 6,198,491 B1
DATED : March 6, 2001
INVENTOR(S) : Takao Honda

It is certified that error appears in the above-identified patent and that said Letters Patent is hereby corrected as shown below:

Column 7,
Line 57, "drum" should read -- drum 1. --.

Column 10,
Line 21, "Conditions" should read -- Conditions: --.

Column 15,
Line 3, "mane" should read -- main --.

Column 19,
Line 37, "Conditions" should read -- Conditions: --.

Column 20,
Line 46, "mane" should read -- main --.

Column 22,
Line 50, "Conditions" should read -- Conditions: --.

Column 23,
Line 37, "Conditions" should read -- Conditions: --.

Column 24,
Line 52, "not.(8)" should read -- not. ¶ (8) --.

Column 26,
Line 38, "on the" should read -- on the --.

Column 27,
Line 16, "Conditions" should read -- Conditions: --.

Column 28,
Line 22, "Conditions" should read -- Conditions: --.

Column 30,
Line 19, "by "$L_a$"." should read -- by "$L_d$". --

Column 32,
Line 17, "Conditions" should read -- Conditions: --; and
Line 19, switche-ON" sholuld read -- switched-ON --.

UNITED STATES PATENT AND TRADEMARK OFFICE

CERTIFICATE OF CORRECTION

PATENT NO. : 6,198,491 B1
DATED : March 6, 2001
INVENTOR(S) : Takao Honda

It is certified that error appears in the above-identified patent and that said Letters Patent is hereby corrected as shown below:

Column 36,
Line 5, "JJ (Normal" should read -- HH, JJ (Normal --; and
Line 35, "Conditions" should read -- Conditions: --.

Signed and Sealed this

Ninth Day of April, 2002

*Attest:*

*Attesting Officer*

JAMES E. ROGAN
*Director of the United States Patent and Trademark Office*